US010249318B2

(12) United States Patent
Kaniewska et al.

(10) Patent No.: US 10,249,318 B2
(45) Date of Patent: Apr. 2, 2019

(54) SPEECH SIGNAL PROCESSING CIRCUIT

(71) Applicant: NXP B.V., Eindhoven (NL)

(72) Inventors: Magdalena Kaniewska, Leuven (BE); Wouter Joos Tirry, Wijgmaal (BE); Cyril Guillaumé, St Josse-Ten-Noode (BE); Johannes Abel, Braunschweig (DE); Tim Fingscheidt, Braunschweig (DE)

(73) Assignee: NXP B.V., Eindhoven (NL)

( * ) Notice: Subject to any disclaimer, the term of this patent is extended or adjusted under 35 U.S.C. 154(b) by 26 days.

(21) Appl. No.: 15/463,093

(22) Filed: Mar. 20, 2017

(65) Prior Publication Data

US 2017/0270946 A1 Sep. 21, 2017

(30) Foreign Application Priority Data

Mar. 21, 2016 (EP) ..... 16161471

(51) Int. Cl.
*G10L 21/0232* (2013.01)
*G10L 21/0388* (2013.01)
(Continued)

(52) U.S. Cl.
CPC ..... *G10L 21/0232* (2013.01); *G10L 21/0388* (2013.01); *G10L 25/60* (2013.01);
(Continued)

(58) Field of Classification Search
None
See application file for complete search history.

(56) References Cited

U.S. PATENT DOCUMENTS 4,490,840 A * 12/1984 Jones ..... G10L 25/00 704/254
6,651,041 B1 11/2003 Juric
(Continued)

FOREIGN PATENT DOCUMENTS

| | | | |
|---|---|---|---|
| DE | 10 2013 005 844 | B3 | 8/2014 |
| EP | 2595145 | A1 | 5/2013 |
| WO | WO-02/101721 | A1 | 12/2002 |

OTHER PUBLICATIONS

International Telecommunication Union; "ITU-T Recommendation P.56, Objective measurement of active speech level"; 24 pages (Dec. 2011).

(Continued)

*Primary Examiner* — Neeraj Sharma

(57) ABSTRACT

A speech-signal-processing-circuit configured to receive a time-frequency-domain-reference-speech-signal and a time-frequency-domain-degraded-speech-signal. The time-frequency-domain-reference-speech-signal comprises: an upper-band-reference-component with frequencies that are greater than a frequency-threshold-value; and a lower-band-reference-component with frequencies that are less than the frequency-threshold-value. The time-frequency-domain-degraded-speech-signal comprises: an upper-band-degraded-component with frequencies that are greater than the frequency-threshold-value; and a lower-band-degraded-component with frequencies that are less than the frequency-threshold-value. The speech-signal-processing-circuit comprises: a disturbance calculator configured to determine one or more SBR-features based on the time-frequency-domain-reference-speech-signal and the time-frequency-domain-degraded-speech-signal by: for each of a plurality of frames: determining a reference-ratio based on the ratio of (i) the upper-band-reference-component to (ii) the lower-band-reference-component; determining a degraded-ratio
(Continued)

based on the ratio of (i) the upper-band-degraded-component to (ii) the lower-band-degraded-component; and determining a spectral-balance-ratio based on the ratio of the reference-ratio to the degraded-ratio; and (ii) determining the one or more SBR-features based on the spectral-balance-ratio for the plurality of frames.

15 Claims, 5 Drawing Sheets

(51) Int. Cl.
*G10L 25/93* (2013.01)
*G10L 25/69* (2013.01)
*G10L 25/60* (2013.01)

(52) U.S. Cl.
CPC ..... *G10L 25/69* (2013.01); *G10L 25/93* (2013.01); *G10L 2025/932* (2013.01)

(56) References Cited

U.S. PATENT DOCUMENTS 9,721,582 B1* 8/2017 Huang ..... G10L 21/0216
2008/0298599 A1* 12/2008 Kim ..... G10L 25/69 381/58
2013/0148525 A1* 6/2013 Cuadra Sanchez ... H04L 41/147 370/252
2013/0282373 A1* 10/2013 Visser ..... G10L 21/0208 704/233
2014/0200881 A1* 7/2014 Chatlani ..... G10L 21/0264 704/205
2014/0316773 A1* 10/2014 Beerends ..... G10L 25/69 704/201
2015/0172807 A1* 6/2015 Olsson ..... G10K 11/175 381/74
2015/0371654 A1* 12/2015 Johnston ..... H04M 9/082 381/66
2016/0112811 A1* 4/2016 Jensen ..... H04R 5/033 381/17
2017/0110142 A1* 4/2017 Fan ..... G10L 21/0216

OTHER PUBLICATIONS

"ETSI EG 202 396-3 v1.2.1, Speech Processing, Transmission and Quality Aspects (STQ); Speech Quality performance in the presence of background noise Part 3: Background noise transmission Objective test methods"; 50 pages (Nov. 2008).
"ETSI TS 103 106 v1.1.1, Speech and multimedia Transmission Quality (STQ); Speech quality performance in the presence of background noise: Background noise transmission for mobile terminals—objective test methods"; 50 pages (Aug. 2012).
"ETSI TS 126 131 v11.0.0, Universal Mobile Telecommunications System (UMTS); LTE; Terminal acoustic characteristics for telephony; Requirements"; 41 pages (Oct. 2012).
International Telecommunication Union; "ITU-T P.862.2, Wideband extension to Recommendation P.862 for the assessment of wideband telephone networks and speech codecs"; 12 pages (Nov. 2007).
International Telecommunication Union; "ITU-T P.1100, Narrow-band hands-free communication in motor vehicles"; 114 pages (Jan. 2015).
International Telecommunication Union; "ITU-T P.48, Specification for an intermediate reference system"; 9 pages (Nov. 1988).
International Telecommuncation Union; "ITU-T P.800, Methods for subjective determination of transmission quality"; 37 pages (Aug. 1996).
International Telecommunication Union; "ITU-T P.861, Objective quality measurement of telephone-band (300-3400 Hz) speech codecs"; 34 pages; (Aug. 1996).
International Telecommunication Union; "ITU-T 862, Perceptual evaluation of speech quality (PESQ): An objective method for end-to-end speech quality assessment of narrow-band telephone networks and speech codecs"; 30 pages (Feb. 2001).
International Telecommunication Union; "ITU-T P.863, Perceptual objective listening quality assessment": 76 pages (Jan. 2011).
Agionmyrgiannakis, Yannis et al; "Combined Estimation/Coding of Highband Spectral Envelopes for Speech Spectrum Expansion"; Proc. of IEEE International Conference on Acoustics, Speech and Signal Processing; 4 pages (Aug. 30, 2004).
Bauer, Patrick et al; "On Speech Quality Assessment of Artificial Bandwidth Extension"; 2014 IEEE Int'l Conf. on Acoustic, Speech and Signal Processing, 5 pages (Jul. 14, 2014).
Fingscheidt, Tim et al; "A Phonetic Reference Paradigm for Instrumental Speech Quality Assessment of Artificial Speech Bandwidth Extension"; Proc. of 4th International Workshop on Perceptual Quality of Systems, Vienna, Austria; 4 pages (Sep. 2013).
Cote, Nicolas et al; "Diagnostic Instrumental Speech Quality Assessment in a Super-Wideband Context"; Proc. of 3rd International Workshop on Perceptual Quality of Systems, Bautzen, Germany; 7 pages (Sep. 2010).
Hansler, Eberhard et al; "Springer Series on Signals and Communication Technology"; Springer; 750 pages rel. pp. 317, 318, 356, 306-332 and 356-363 (2008).
Lepage, Marc et al; "Scalable Perceptual Based Echo Assessment Method for Aurally Adequate Evaluation of Residual Single Talk Echoes"; Proc. of Int'l. Workshop on Acoustic Signal Enhancement 2012, Aachen, Germany; 4 page (Sep. 2012).
Moller, Sebastian et al; "Speech Quality Prediction for Artificial Bandwidth Extension Algorithms"; Proc. of Interspeech, Lyon, France; pp. 3439-3443 (Aug. 2013).
Santos, Joao Felipe et al; "Performance Comparison of Intrusive Objective Speech Intelligibility and Quality Metrics for Cochlear Implant Users"; Proc. of INTERSPEECH, vol. 1; 4 pages (2012).
Sottek, Roland; "Models for signal processing in human hearing"; Dissertation, Electrical Engineering of the RWTH Aachen University; 188 pages; English translation of Title page and Summary pp. 160-161; (Jun. 8, 1993).

* cited by examiner

SPEECH SIGNAL PROCESSING CIRCUIT

CROSS-REFERENCE TO RELATED APPLICATIONS

This application claims the priority under 35 U.S.C. § 119 of European patent application no. 16161471.4, filed Mar. 21, 2016 the contents of which are incorporated by reference herein.

The present disclosure relates to speech signal processing circuits, particularly those that can generate an output score that is representative of a degraded speech signal.

According to a first aspect of the present disclosure there is provided a speech-signal-processing-circuit configured to receive a time-frequency-domain-reference-speech-signal and a time-frequency-domain-degraded-speech-signal, wherein each of the time-frequency-domain-reference-speech-signal and the time-frequency-domain-degraded-speech-signal comprises a plurality of frames of data, wherein:

- the time-frequency-domain-reference-speech-signal is in the time-frequency domain and comprises:
  - an upper-band-reference-component with frequencies that are greater than a frequency-threshold-value; and
  - a lower-band-reference-component with frequencies that are less than the frequency-threshold-value;
- the time-frequency-domain-degraded-speech-signal is in the time-frequency domain and comprises:
  - an upper-band-degraded-component with frequencies that are greater than the frequency-threshold-value; and
  - a lower-band-degraded-component with frequencies that are less than the frequency-threshold-value;
- the speech-signal-processing-circuit comprises:
  - a disturbance calculator configured to determine one or more SBR-features based on the time-frequency-domain-reference-speech-signal and the time-frequency-domain-degraded-speech-signal by:
    - (i) for each of a plurality of frames:
      - determining a reference-ratio based on the ratio of (i) the upper-band-reference-component to (ii) the lower-band-reference-component;
      - determining a degraded-ratio based on the ratio of (i) the upper-band-degraded-component to (ii) the lower-band-degraded-component; and
      - determining a spectral-balance-ratio based on the ratio of the reference-ratio to the degraded-ratio; and
    - (ii) determining the one or more SBR-features based on the spectral-balance-ratio for the plurality of frames; and
  - a score-evaluation-block configured to determine an output-score for the degraded-speech-signal based on the SBR-features.

In one or more embodiments, the time-frequency-domain-degraded-speech-signal is representative of an extended bandwidth signal. The frequency-threshold-value may correspond to a boundary between a lower band of the extended bandwidth signal, and an upper band of the extended bandwidth signal.

In one or more embodiments the upper band of the extended bandwidth signal corresponds to a frequency band that has been added by an artificial bandwidth extension algorithm. The lower band of the extended bandwidth signal may correspond to a band-limited signal that has been extended by the artificial bandwidth extension algorithm In one or more embodiments the disturbance calculator is configured to determine one or more of the following SBR-features:

- a mean value of the spectral-balance-ratio for frames that have a positive value of spectral-balance-ratio;
- a mean value of spectral-balance-ratio for frames that have a negative value of spectral-balance-ratio;
- a variance value of spectral-balance-ratio for frames that have a positive value of spectral-balance-ratio;
- a variance value of spectral-balance-ratio for frames that have a negative value of spectral-balance-ratio; and
- a ratio of (i) the number of frames that have a positive value of spectral-balance-ratio, to (ii) the number of frames that have a negative value of spectral-balance-ratio.

In one or more embodiments the speech-signal-processing-circuit is configured to receive a reference-speech-signal and a degraded-speech-signal. Each of the reference-speech-signal and the degraded-speech-signal may comprise a plurality of frames of data. The speech-signal-processing-circuit may comprise:

- a reference-time-frequency-block configured to determine the time-frequency-domain-reference-speech-signal based on the reference-speech-signal; and
- a degraded-time-frequency-block configured to determine the time-frequency-domain-degraded-speech-signal based on the degraded-speech-signal.

The reference-speech-signal and the degraded-speech-signal may be in the time domain.

In one or more embodiments the reference-time-frequency-block comprises a reference-perceptual-processing-block and the degraded-time-frequency-block comprises a degraded-perceptual-processing-block. The reference-perceptual-processing-block and the degraded-perceptual-processing-block may be configured to simulate one or more aspects of human hearing.

In one or more embodiments the disturbance calculator comprises a time-frequency domain feature extraction block configured to:

- process the time-frequency-domain-reference-speech-signal and the time-frequency-domain-degraded-speech-signal; and
- determine one or more additional time-frequency-domain-features; and wherein the score-evaluation-block is configured to determine the output-score based on the time-frequency-domain-features.

In one or more embodiments the time-frequency domain feature extraction block comprises a Normalized Covariance Metric block configured to:

- process the time-frequency-domain-reference-speech-signal and the time-frequency-domain-degraded-speech-signal in order to calculate a Normalized Covariance Metric feature, wherein the Normalized Covariance Metric is based on the covariance between the time-frequency-domain-reference-speech-signal and the time-frequency-domain-degraded-speech-signal; and wherein the score-evaluation-block is configured to determine the output-score based on the Normalized Covariance Metric.

In one or more embodiments the time-frequency domain feature extraction block comprises an absolute distortion block configured to:

- process the time-frequency-domain-reference-speech-signal and the time-frequency-domain-degraded-speech-signal in order to calculate an Absolute Distortion, wherein the Absolute Distortion represents the absolute difference between the time-frequency-domain-reference-speech-signal and the time-frequency-domain-degraded-speech-signal; and determine one or more of the following absolute-distortion-features based on the Absolute Distortion:

a mean value of Absolute Distortion for frames that include speech;

a variance value of Absolute Distortion for frames that include speech;

a mean value of Absolute Distortion for frames that include speech and for which Absolute Distortion is positive;

a variance value of Absolute Distortion for frames that include speech and for which Absolute Distortion is positive;

a mean value of Absolute Distortion for frames that include speech and for which Absolute Distortion is negative;

a variance value of Absolute Distortion for frames that include speech and for which Absolute Distortion is negative;

a mean value of Absolute Distortion for frames that include speech, and for which Absolute Distortion is positive, and for upper-band frequency components;

a variance value of Absolute Distortion for frames that include speech, and for which Absolute Distortion is positive, and for upper-band frequency components;

a mean value of Absolute Distortion for frames that include speech and for which Absolute Distortion is negative, and for upper-band frequency components;

a variance value of Absolute Distortion for frames that include speech and for which Absolute Distortion is negative, and for upper-band frequency components; and wherein the score-evaluation-block is configured to determine the output-score based on the absolute-distortion-features.

In one or more embodiments the time-frequency domain feature extraction block comprises a relative distortion block configured to:

process the time-frequency-domain-reference-speech-signal and the time-frequency-domain-degraded-speech-signal in order to calculate a Relative Distortion as a signal-to-distortion ratio; and determine one or more of the following relative-distortion-features based on the Relative Distortion:

a mean value of Relative Distortion for frames that include speech;

a variance value of Relative Distortion for frames that include speech;

wherein the score-evaluation-block is configured to determine the output-score based on one or more of the relative-distortion-features.

In one or more embodiments the time-frequency domain feature extraction block comprises a two-dimensional correlation block configured to process the time-frequency-domain-reference-speech-signal and the time-frequency-domain-degraded-speech-signal in order to calculate a two-dimensional correlation value; and wherein the score-evaluation-block is configured to determine the output-score based on the two-dimensional correlation value.

In one or more embodiments the speech-signal-processing-circuit is configured to receive a reference-speech-signal and a degraded-speech-signal, wherein the time-frequency-domain-reference-speech-signal is a time-frequency domain representation of the reference-speech-signal, and the time-frequency-domain-degraded-speech-signal is a time-frequency domain representation of the degraded-speech-signal. The disturbance calculator may comprise a time domain sample-based feature extraction block configured to:

receive time domain representations of the reference-speech-signal and the degraded-speech-signal; and determine one or more sample-based-features based on the time domain representations of the reference-speech-signal and the degraded-speech-signal; and wherein the score-evaluation-block is configured to determine the output-score based on the sample-based-features.

In one or more embodiments the time domain sample-based feature extraction block comprises a GSDSR block configured to perform sample-based processing on the time domain representations of the reference-speech-signal and the degraded-speech-signal signals in order to determine a Global Signal-to-Degraded-Speech Ratio, wherein the Global Signal-to-Degraded-Speech Ratio is indicative of a comparison of energy derived over all samples of the reference-speech-signal and the degraded-speech-signal; and wherein the score-evaluation-block is configured to determine the output-score based on the Global Signal-to-Degraded-Speech Ratio.

In one or more embodiments the speech-signal-processing-circuit is configured to receive a reference-speech-signal and a degraded-speech-signal, wherein the time-frequency-domain-reference-speech-signal is a time-frequency domain representation of the reference-speech-signal, and the time-frequency-domain-degraded-speech-signal is a time-frequency domain representation of the degraded-speech-signal. The disturbance calculator may comprise a time domain frame-based feature extraction block configured to:

receive framed, time domain, representations of the reference-speech-signal and the degraded-speech-signal; and determine one or more frame-based-features based on the framed, time domain, representations of the reference-speech-signal and the degraded-speech-signal; and wherein the score-evaluation-block is configured to determine the output-score based on the frame-based-features.

In one or more embodiments the disturbance calculator comprises a SSDR block configured to:

process the framed, time domain, representations of the reference-speech-signal and the degraded-speech-signal in order to determine a Speech-to-Speech Distortion-Ratio; and determine one or more of the following SSDR-features based on the Speech-to-Speech Distortion-Ratio:

a mean value of Speech-to-Speech Distortion-Ratio for frames that include speech, a mean value of Speech-to-Speech Distortion-Ratio for frames that do not include speech, a variance value of Speech-to-Speech Distortion-Ratio for frames that include speech, a variance value of Speech-to-Speech Distortion-Ratio for frames that do not include speech; and wherein the score-evaluation-block is configured to determine the output-score based on one or more of the SSDR-features.

In one or more embodiments the disturbance calculator comprises a LSD block configured to:

process time-frequency domain representations of the reference-speech-signal and the degraded-speech-signal in order to determine a Log Spectral Distortion; and determine one or more of the following LSD-features based on the Log Spectral Distortion:

a mean value of Log Spectral Distortion for frames that include speech;

a variance value of Log Spectral Distortion for frames that include speech; and wherein the score-evaluation-block is configured to determine the output-score based on one or more of the LSD-features.

In one or more embodiments the speech-signal-processing-circuit further comprises an input layer that is configured to receive an input-reference-speech-signal and an input-degraded-speech-signal. The input layer may comprise:

level adjustment blocks configured to provide the reference-speech-signal and the degraded-speech-signal by performing level adjustment of the input-reference-speech-signal and the input-degraded-speech-signal based on the level of the input-reference-speech-signal and the input-degraded-speech-signal at frequencies that are less than the frequency-threshold-value.

In one or more embodiments the speech-signal-processing-circuit is further configured to receive a voice-indication-signal, wherein the voice-indication-signal is indicative of whether or not frames of the reference-speech-signal and the degraded-speech-signal contain speech. The disturbance calculator may be configured to determine one or more of the following features based on the voice-indication-signal:

only frames of the reference-speech-signal and the degraded-speech-signal for which the voice-indication-signal is indicative of speech being present, or only frames of the reference-speech-signal and the degraded-speech-signal for which the voice-indication-signal is indicative of speech not being present.

There may be provided a method of processing a degraded-speech-signal, the method comprising:

receiving a time-frequency-domain-reference-speech-signal comprising a plurality of frames of data, wherein the time-frequency-domain-reference-speech-signal is in the time-frequency domain and comprises:

an upper-band-reference-component with frequencies that are greater than a frequency-threshold-value; and a lower-band-reference-component with frequencies that are less than the frequency-threshold-value;

receiving a time-frequency-domain-degraded-speech-signal comprising a plurality of frames of data, wherein the time-frequency-domain-degraded-speech-signal is in the time-frequency domain and comprises:

an upper-band-degraded-component with frequencies that are greater than the frequency-threshold-value; and a lower-band-degraded-component with frequencies that are less than the frequency-threshold-value;

determining one or more SBR-features based on the time-frequency-domain-reference-speech-signal and the time-frequency-domain-degraded-speech-signal by, for a plurality of frames:

determining a reference-ratio based on the ratio of (i) the upper-band-reference-component to (ii) the lower-band-reference-component;

determining a degraded-ratio based on the ratio of (i) the upper-band-degraded-component to (ii) the lower-band-degraded-component; and determining a spectral-balance-ratio based on the ratio of the reference-ratio to the degraded-ratio; and determining the one or more SBR-features based on the spectral-balance-ratio for the plurality of frames; and determining an output-score for the degraded-speech-signal based on the SBR-features.

There may be provided an integrated circuit or device comprising any circuit or system disclosed herein, or configured to perform any method disclosed herein.

There may also be provided a computer program, which when run on a computer, causes the computer to configure any apparatus, including a circuit, system or device disclosed herein or perform any method disclosed herein.

While the disclosure is amenable to various modifications and alternative forms, specifics thereof have been shown by way of example in the drawings and will be described in detail. It should be understood, however, that other embodiments, beyond the particular embodiments described, are possible as well. All modifications, equivalents, and alternative embodiments falling within the spirit and scope of the appended claims are covered as well.

The above discussion is not intended to represent every example embodiment or every implementation within the scope of the current or future Claim sets. The figures and Detailed Description that follow also exemplify various example embodiments. Various example embodiments may be more completely understood in consideration of the following Detailed Description in connection with the accompanying Drawings.

BRIEF DESCRIPTION OF DRAWINGS

One or more embodiments will now be described by way of example only with reference to the accompanying drawings in which.

DETAILED DESCRIPTION

Subjective listening tests can be considered as a reliable method for assessing the quality of speech. They can be, however, costly and time-consuming. Alternatively, objective, automatic methods can be used to facilitate the procedures of quality assessment for speech processing algorithms, codecs, devices and networks. They span from very simple measures such as Signal-to-Noise Ratio (SNR) or Spectral Distance (SD) to complex approaches that include psychoacoustic processing and cognitive (statistical) models.

The latter family are measures designed to predict the scores of subjective listening tests. A known representative of this family is an ITU-T standard series that started in 1997 with PSQM (perceptual speech quality measure), which was later withdrawn and replaced by PESQ (perceptual evaluation of speech quality) and its wideband version WB-PESQ, and then completed with POLQA (perceptual objective listening quality assessment) in 2011. The measures from this series are widely used, since they can be applied in many different use cases (test factors such as linear and nonlinear distortions or packet losses, coding techniques, applications such as codec evaluations, terminal or network testing, assessment of speech enhancement algorithms, devices and the like). A similar, no longer used measure was TOSQA (telecommunication objective speech quality assessment), developed in 1998. Other objective measures are more specialized, limited to one application, such as evaluation of echo cancellation (EQUEST) or noise reduction (3QUEST).

All of the above-mentioned measures are intrusive ones, that is, the quality of the sample under test (degraded signal) is being estimated through comparison with a reference signal.

Figure 1:
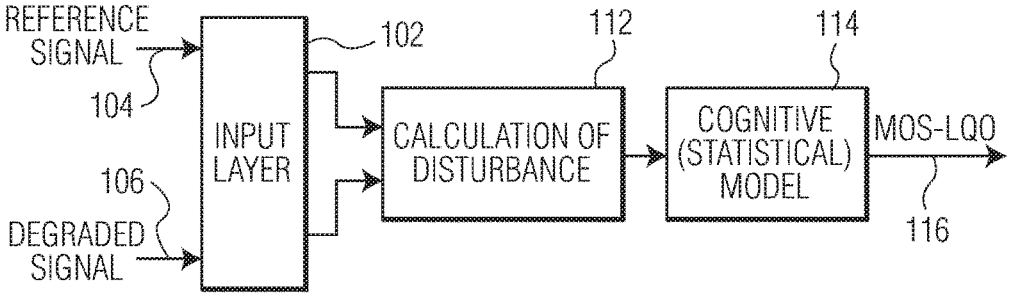
FIG. 1 illustrates a general block diagram of a system that can be used to determine the quality of a signal under test using an intrusive instrumental measure.

FIG. 1 illustrates a general block diagram of a system that can be used to determine the quality of a signal under test in an intrusive way.

FIG. 1 shows an input layer 102 that receives an input-reference-speech-signal 104 and an input-degraded-speech-signal 106. The input layer 102 may consist of several pre-processing blocks, for example, to perform time alignment between the input-reference-speech-signal 104 and the input-degraded-speech-signal 106, voice activity detection, level adjustments, etc. Further details will be provided below. The input layer 102 provides processed versions of the reference signal and degraded signal to the disturbance calculator 112.

The disturbance calculator 112 can compute one or more quality indicators, which may also be referred to as features or disturbances (because they are indicators of differences between the reference signal 104 and the degraded signal 106). Before the disturbance calculator 112 computes quality indicators, it can calculate new representations for both input signals. An example can be time-frequency domain representations of the signals received by the disturbance calculator 112. Such time-frequency domain representations can be provided by a perceptual model, used to simulate chosen aspects of human hearing (for example, to apply time or frequency masking, hearing thresholds, auditory filters). The output terminal of the disturbance calculator 112 is connected to a cognitive (statistical) model 114, which provides a MOS-LQO (Mean Opinion Score-Listening Quality Objective) output signal/output score 116.

The cognitive (statistical) model 114, which may also be referred to as a quality score predictor, can be implemented as a (multivariate) linear or quadratic regression (as in PESQ, POLQA, 3QUEST), artificial neural network (as in EQUEST, 3QUEST), or any other trained statistical model.

Certain modifications to this general model of FIG. 1 are possible, to put more emphasis on different quality factors. For example, for artificial bandwidth extension (ABE) solutions, the reconstruction of fricative sounds can be of higher importance. Fricative sounds in general have most of their spectral content above 4 kHz and are therefore not well-represented in narrowband (NB) speech. ABE will be discussed in more detail below.

A correct reconstruction of fricative sounds, especially/s/ and/z/sounds, can have a high impact on the perceived speech quality. In general, the perception of speech quality depends to a certain degree on the sounds occurring in the speech signal. To make use of this quality factor, a reference-based speech quality measurement system can use not only a degraded and a reference speech signal as inputs, but also the phonetic transcription of the speech signal to apply modifications to any part of the scheme shown in FIG. 1. Depending on the transcription, a certain weighting within the perceptual models or the calculation of the disturbance by the disturbance calculator 112 might be adjusted to attenuate the influence of chosen sounds (for example the formerly mentioned fricative sounds /s/ or /z/).

A different example is the "Diagnostic Instrumental Assessment of Listening quality" (DIAL), which has been developed as part of the POLQA project. DIAL follows an assumption that the combination of several specialized measures is more efficient than one single complex measure, and therefore combines a core measure (that implements the general model of FIG. 1) with four specified quality dimensions (directness/frequency content, continuity, noisiness and loudness).

There is no standardized objective measure designed specifically for ABE-processed speech signals. WB-PESQ and POLQA, which can be considered as general measures, were tested for accuracy of prediction of the "Mean Opinion Score-Listening Quality Subjective" (MOS-LQS) for ABE-processed signals. However, the results showed that neither of them exhibited sufficiently high correlation with the listening test scores and therefore cannot be considered as a reliable quality estimator for ABE solutions.

Also, using an approach that requires an additional input of a time-aligned phonetic transcription can be tedious, and can bear the risk of a language-dependent solution. Instrumental measures of speech quality, however, should aim at predicting reliable MOS scores in virtually all languages of the world.

One more examples disclosed below can be especially relevant to speech signals that have been processed with ABE (artificial bandwidth extension) algorithms. An ABE algorithm can expand the frequency range of an input signal, which has a limited band, by estimating and generating the content beyond those limits. For example in case of a wideband (WB) ABE algorithm, an input narrowband (NB) signal has a frequency range of 0 Hz<=f<=4 kHz, providing lower-band content. The ABE algorithm can extend that range up to 8 kHz by generating upper-band content (above a threshold frequency which is in this case equal to 4 kHz). In this example, a lower band has frequency content between 0 and 4 kHz, and an upper band has frequency content between 4 kHz and 8 kHz.

Figure 2:
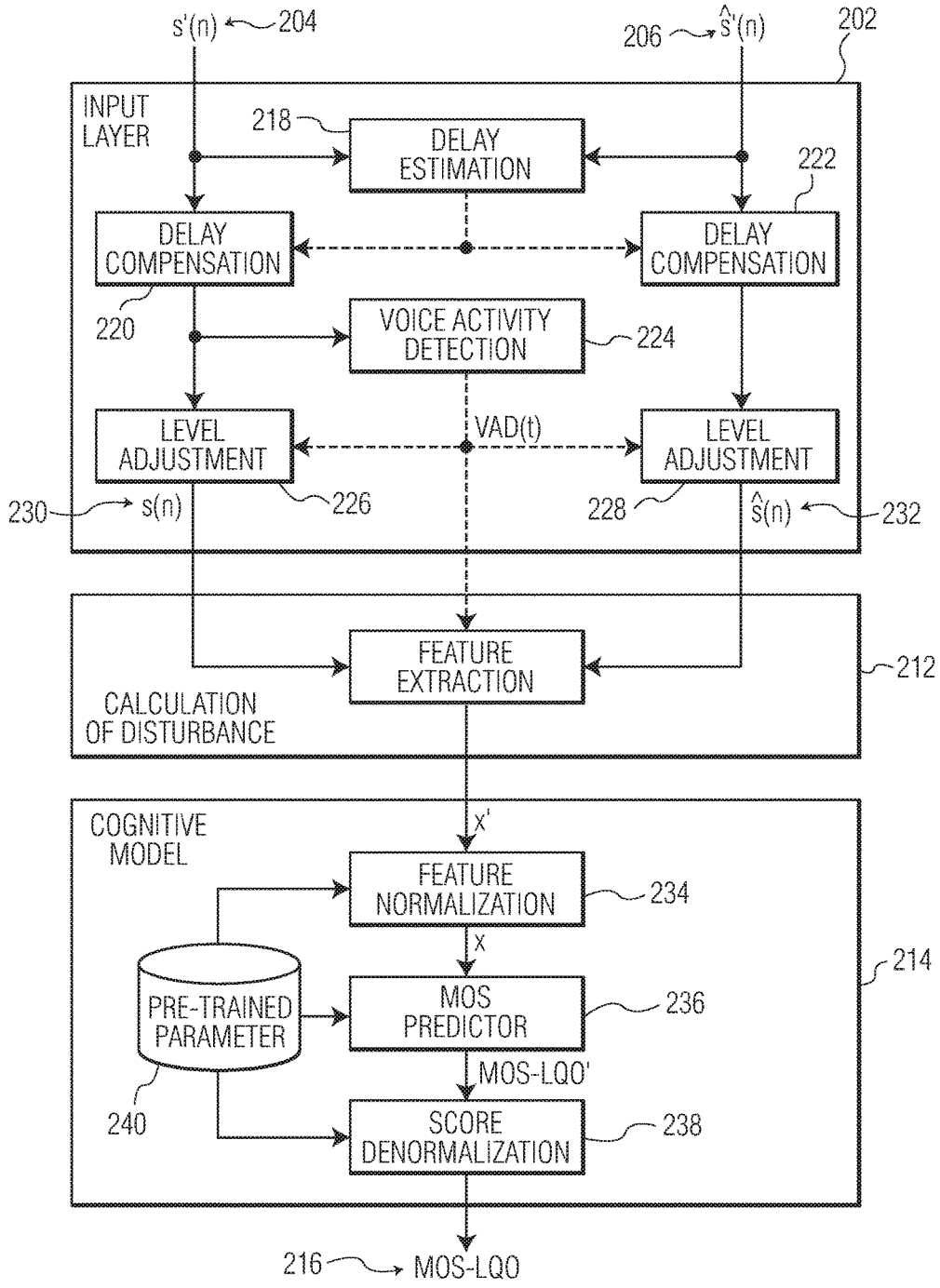
FIG. 2 illustrates a block diagram of a system that can be used to determine the quality of an ABE-processed, degraded signal.

FIG. 2 illustrates a block diagram of a system that can be used to determine the quality of an ABE-processed, degraded signal.

The ABE-processed speech signal, also referred to as signal under test or input-degraded-speech-signal 206, is denoted by $\hat{s}'(n)$, with $$n \in \mathcal{N}\{0,1,\ldots,N_s-1\}$$

being the sample index and $N_s$ the total number of samples in the signal. This example is based on an intrusive scheme for determining the quality of the input-degraded-speech-signal 206, and therefore an input-reference-speech-signal s'(n) 204 is used for performing the quality assessment of $\hat{s}'(n)$ 206. The input-reference-speech-signal 204 has both lower-band and upper-band frequency content and is free from disturbances resulting from transmission, coding or other processing. Limitation of the effective acoustical bandwidth can be an exception. For example, for WB signals the maximum (theoretical) bandwidth is 0 Hz<=f<=8000 Hz. However, in practice, a mask can be applied to reduce this bandwidth.

The effective bandwidth of WB speech in one implementation is defined as 50 Hz<=f<=7000 Hz, although it will be appreciated that the bandwidth could be any other value within the theoretical range. In this implementation both, $\hat{s}'(n)$ 206 and s'(n) 204 are sampled at least at fs=16 kHz to fulfil the Nyquist criterion.

The system of FIG. 2 includes an input layer 202 that can perform delay compensation, voice activity detection and level adjustment.

Since this example is based on an intrusive scheme, satisfactory time alignment can be very important in order for the two input signals to be compared accurately. Due to speech coding, transmission or speech enhancement algorithms, such as ABE, a delay might be introduced to the input-degraded-speech-signal 206. Therefore, the delay between both input signals 204, 206 should be calculated and compensated for.

As shown in FIG. 2, a delay estimation block 218 can be used to estimate the delay between the input-reference-speech-signal 204 and the input-degraded-speech-signal 206, and one or two delay compensation blocks 220, 222 can be used to apply a delay compensation to the input-reference-speech-signal 204 and/or the input-degraded-speech-signal 206. Time alignment can be achieved by calculating the cross-correlation between the input-reference-speech-signal 204 and the input-degraded-speech-signal 206, and then shifting the input-degraded-speech-signal 206 to the maximum of the cross-correlation function, and vice versa. Consequently, both input signals 204, 206 can be cut to the length of the shorter input signal. Zero-padding of the input-degraded-speech-signal 206 or the input-reference-speech-signal 204 might be used so that the same amount of samples are in both input signals 204, 206. It will be appreciated that other methods can also be used to time align the input signals 204, 206. More refined methods can be used to perform time alignment on short segments of speech extracted from the entire input signals 204, 206.

In the implementation of FIG. 2, a voice activity detector (VAD) 224 performs voice activity detection on the reference input s'(n), which results in a voice-indication-signal VAD(t). The voice-indication-signal VAD(t) in this example includes frame-wise VAD values, where t is the frame index. The voice-indication-signal VAD(t) provides information about voice-active parts of the signal (VAD(t)=1) and silent parts (VAD(t)=0) in dependence of their temporal position as defined by the frame index t. Therefore, frames of data can be spaced apart in the time domain.

It will be appreciated that the VAD 224 can process the input-reference-speech-signal 204, the input-degraded-speech-signal 206, or both (and then combine the results into a single decision that is indicative of whether or not speech is present). In some examples it can be advantageous for the VAD 224 to process the input-reference-speech-signal 204 (or a signal based on the input-reference-speech-signal 204), since this signal is substantially free of distortion.

In examples where the VAD 224 calculates frame-wise VAD values, a simple thresholding of energy can be used. More sophisticated solutions, for example using adaptive thresholds, can also be applied.

The input layer in this example also includes two level adjustment blocks 226, 228 for adjusting the power levels of the respective signals provided by the delay compensation blocks 220, 222. The level adjustment blocks 226, 228 can normalize their input signals with respect to an active speech level. The level adjustment blocks 226, 228 can determine the active speech level using the voice-indication-signal VAD(t) from the VAD 224.

In some examples, the difference of levels between the input-reference-speech-signal 204 and the input-degraded-speech-signal 206 can be considered a quality factor and therefore can serve as an additional feature. However, if this is not the case then the input signals (reference 204 and degraded 206) can be scaled towards the same global level, or the input-degraded-speech-signal 206 can be scaled towards the level of the input-reference-speech-signal 204. For ABE algorithms, the difference of levels in the upper band can be of particular importance, and therefore the level adjustment blocks 226, 228 can perform level adjustment based on the level of the input-reference-speech-signal 204 and the input-degraded-speech-signal 206 in the lower-band (LB) frequency range only (at frequencies that are less than a frequency-threshold-value). That is, the upper-band components of the two input signals 204, 206 may not be used to adjust the level of the input-reference-speech-signal 204 or the degraded signal.

The level adjustment blocks 226, 228 can measure the input levels of the signals and apply any scaling factors by means of the root mean square value over speech-active frames. This can be accomplished by employing ITU-T Recommendation P.56 or any similar level measurement method operating either in batch mode or in a sample- or frame-wise fashion.

The two level adjustment blocks 226, 228 respectively provide a reference-speech-signal s(n) 230 and a degraded-speech-signal ŝ(n) 232 for subsequent feature extraction.

It will be appreciated that the input layer 202 can include other pre-processing blocks, for example to resample the input signals towards a common sampling frequency, or (Modified) Intermediate Reference System ((M)IRS) filters, or other filters.

After the degraded-speech-signal ŝ(n) 232 and the reference-speech-signal s(n) 230 have been aligned in time, and had their levels adjusted by the input layer 202, features describing the difference between the reference and degraded speech signal can be calculated by a disturbance calculator 212. As will be discussed in detail below with reference to FIGS. 4 and 5, the features can be derived from different representations of the input signals: a time domain representation (sample- and frame-wise calculation of features); and a time-frequency domain representation (e.g., Short-Time Fourier Transform (STFT), or Discrete Cosine Transform (DCT), or any other signal transform from time to time-frequency domain) with optional additional processing applied (such as filter banks or spectral weighing), or a hearing model (perceptual model) representation. Since the hearing model can perform a time-frequency analysis, all features derived from this model could be also calculated from a different time-frequency representation, such as the STFT, but in that case, they would not account for the psychoacoustic effects included in the perceptual model.

The disturbance calculator 212 can extract/determine features of the degraded-speech-signal ŝ(n) 232, for use in determining an output score such as a MOS-LQO 216. In particular, in some examples one or more SBR-features can be determined based on a spectral-balance-ratio for a plurality of frames in both the degraded-speech-signal ŝ(n) 232 and the reference-speech-signal s(n) 230. Use of such SBR-features can be particularly advantageous for detecting errors in ABE signals. The disturbance calculator 212 can output a feature vector x' that includes one or more of the features of the input-degraded-speech-signal 206 that are described in this document, including any SBR-features that are determined.

The system of FIG. 2 also includes a cognitive model 214, also referred to as score evaluation block, which in this example includes a feature normalization block 234, a MOS predictor block 236 and a score denormalization block 238. Each of these blocks can use pre-trained parameters that are accessible from memory 240.

Depending on the training strategy of the cognitive model 214, it can be beneficial for the normalization block 234 to perform normalization of the feature vector x'. If so, then scaling factors and offsets for each dimension of the feature vector x' are calculated during training and used here to normalize the extracted feature vector x', leading to the normalized feature vector x. Without normalization, x=x' holds. When using linear regression as the cognitive model 214, the application of scaling factors and offsets to the feature dimensions may be achieved implicitly.

Extracted features represent the observed distortion in the input-degraded-speech-signal 206 and thus are the link to a predicted MOS-LQO value 216. The MOS predictor 236 in this example has been trained in advance, and therefore uses the pre-trained parameters stored in memory 240. To improve the performance for bandwidth-extended (BE) signals, the model's training set can consist predominantly of speech samples processed with ABE algorithms.

If the MOS predictor 236 was trained on normalized MOS-LQS values, it first estimates MOS-LQO' values, which are also in a normalized range. Therefore, the normalized values can be denormalized by the score denormalization block 238 so that they are shifted towards a typical MOS range using pre-calculated scaling factors and offsets, such that the MOS-LQO 216 can be provided as an output.

Figure 3:
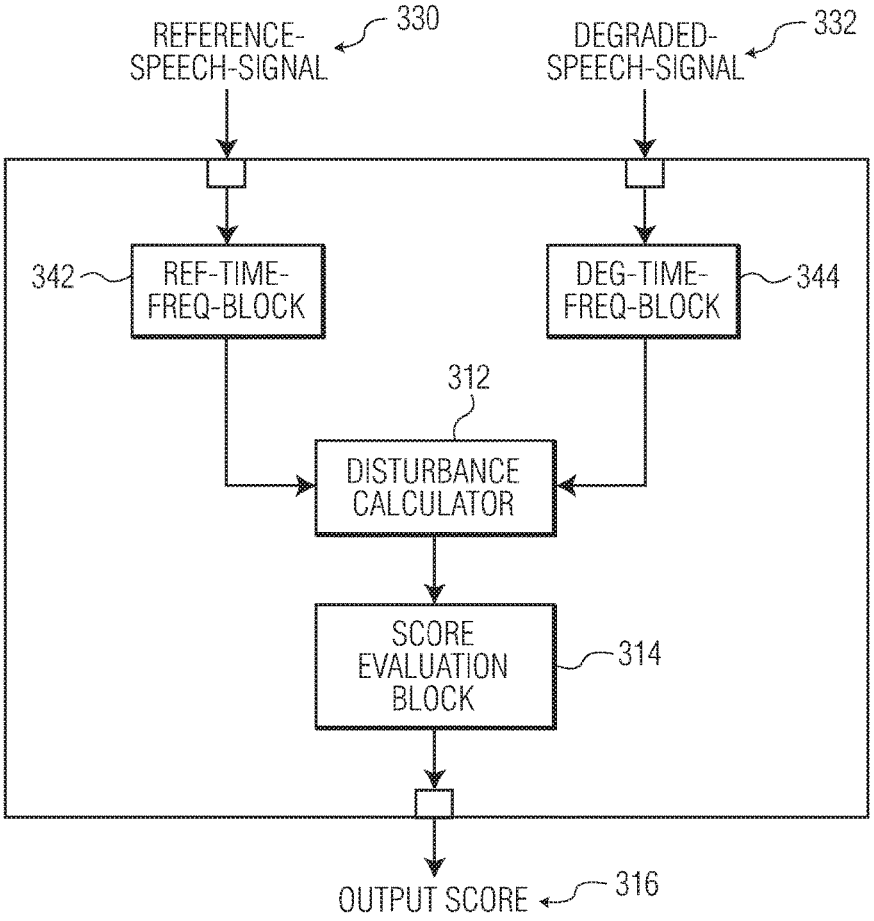
FIG. 3 shows a speech-signal-processing-circuit that includes some, but not all blocks, of the system of FIG. 2.

FIG. 3 shows a speech-signal-processing-circuit 300 that includes some, but not all blocks, of the system of FIG. 2. FIG. 3 will be used to discuss the specific example of the disturbance calculator determining SBR-features for use in determining an output score 316.

The speech-signal-processing-circuit 300 receives a reference-speech-signal 330 and a degraded-speech-signal 332, for example from an input layer such as the one illustrated in FIG. 2. Each of the reference-speech-signal and the degraded-speech-signal comprises a plurality of frames of data, and in this example are in the time domain.

The speech-signal-processing-circuit 300 includes a reference-time-frequency-block 342 and a degraded-time-frequency-block 344. The reference-time-frequency-block 342 determines a time-frequency-domain-reference-speech-signal based on the reference-speech-signal 330. The time-frequency-domain-reference-speech-signal is in the time-frequency domain and comprises: (i) an upper-band-reference-component, which corresponds to components of the time-frequency-domain-reference-speech-signal with frequencies that are greater than a frequency-threshold-value; and a lower-band-reference-component, which corresponds to components of the time-frequency-domain-reference-speech-signal with frequencies that are less than the frequency-threshold-value. The frequency-threshold-value can correspond to the upper limit of a narrowband signal that has been extended by an ABE algorithm, in which case the lower band corresponds to the input signal to the ABE algorithm, and the upper band corresponds to the extended frequency components that have been added by the ABE algorithm. For the numerical example that is described above, the frequency-threshold-value would be 4 kHz.

In a similar way, the degraded-time-frequency-block 344 determines a time-frequency-domain-degraded-speech-signal based on the degraded-speech-signal 332. The time-frequency-domain-degraded-speech-signal is in the time-frequency domain and comprises: (i) an upper-band-degraded-component, which corresponds to components of the time-frequency-domain-degraded-speech-signal with frequencies that are greater than the frequency-threshold-value; and (ii) a lower-band-degraded-component, which corresponds to components of the time-frequency-domain-degraded-speech-signal with frequencies that are less than the frequency-threshold-value.

The functionality of the reference-time-frequency-block 342 and the degraded-time-frequency-block 344 can in some examples be provided by a perceptual model block that simulates one or more aspects of human hearing.

The disturbance calculator 312 can determine a spectral-balance-ratio (SBR) based on the time-frequency-domain-reference-speech-signal and the time-frequency-domain-degraded-speech-signal for a plurality of frames. The spectral-balance-ratio is calculated by:

- determining a reference-ratio based on the ratio of (i) the upper-band-reference-component to (ii) the lower-band-reference-component;
- determining a degraded-ratio based on the ratio of (i) the upper-band-degraded-component to (ii) the lower-band-degraded-component; and
- determining a spectral-balance-ratio based on the ratio of the reference-ratio to the degraded-ratio.

In this way, the spectral balance ratio (SBR) can represent the relation of two frequency bands of both input signals. Besides the correct estimation of the spectral shape of the missing upper band, having the correct energy in the missing band can also play an important role in subjective quality perception. In addition, the spectral balance between lower and upper frequency components should be restored appropriately by the ABE algorithm. Therefore, the energy ratio defined by the SBR is designed to not only compare the energy of the artificially extended frequency components (the upper band), but also to compare the resulting spectral balance of the degraded signal to the reference signal.

Mathematically, the SBR can be represented as:

$$SBR(l) = 10\log_{10}\left(\frac{\mu(|H(l,b)|^2;\mathcal{B}_{UB})\cdot\mu(|\hat{H}(l,b)|^2;\mathcal{B}_{LB})}{\mu(|\hat{H}(l,b)|^2;\mathcal{B}_{UB})\cdot\mu(|H(l,b)|^2;\mathcal{B}_{LB})}\right),$$

Where:

- $|H(l,b)|^2$ is the absolute squared time-frequency-domain-reference-speech-signal in the time frequency domain,
- $|\hat{H}(l,b)|^2$ is the absolute squared time-frequency-domain-degraded-speech-signal in the time frequency domain,
- l is representative of a frame index, and therefore serves as the time index of the time-frequency domain signal,
- b is representative of a frequency bin index or frequency band index, and therefore indexes the frequency domain part of the time-frequency domain signal,
- $B_{UB}$ represents the set of frequency indices b specifying the upper band,
- $B_{LB}$ represents the set of frequency indices b specifying the lower band, and
- $\mu(X(l,b); B)$ represents the (weighted) mean of a time-frequency signal X, where the mean is computed over frequencies with indices b in B.

This equation represents a ratio of energy levels in each of the upper- and lower-band-components.

A positive value of SBR is indicative of the energy in the upper band of the degraded signal being too low, and a negative value of SBR is indicative of the energy in the upper band of the degraded signal being too high. Mathematically:

$$\mathcal{L}_{SBR+}=\{l|SBR(l)>0\}$$

$$\mathcal{L}_{SBR-}=\{l|SBR(l)\leq 0\}$$

$L_{SBR+}$ denotes the set of frames in which a positive (+) imbalance was found, that is, the upper band of the ABE-processed signal (degraded signal) is lacking energy in the upper band and/or contains too much energy in the lower band. The spectral contour of the degraded signal is thus characterized by a higher slope than the one from the reference signal. $L_{SBR-}$ denotes the opposite.

The disturbance calculator 312 can then determine one or more SBR-features based on the spectral-balance-ratio for the plurality of frames. Examples of SBR-features include:

a) a mean value of SBR for frames that have a positive value of SBR, $$\mu SBR(l); \mathcal{L}_{SBR+});$$

b) a mean value of SBR for frames that have a negative value of SBR, $$\mu(SBR(l); \mathcal{L}_{SBR-});$$

c) a variance value of SBR for frames that have a positive value of SBR, $$\sigma^2(SBR(l); \mathcal{L}_{SBR+});$$

d) a variance value of SBR for frames that have a negative value of SBR, $$\sigma^2(SBR(l); \mathcal{L}_{SBR-})$$

e) the ratio of (i) the number of frames that have a positive value of SBR, to (ii) the number of frames that have a negative value of SBR, $$\frac{|\mathcal{L}_{SBR+}|}{|\mathcal{L}_{SBR-}|}.$$

The above mathematical notations will be described further with reference to other calculations that can be performed by the disturbance calculator 312 in order to determine other features.

The speech-signal-processing-circuit 300 also includes a score-evaluation-block 314 for determining an output-score 316 for the degraded-speech-signal 332 based on the SBR-features. The score-evaluation-block 314 can apply a cognitive model. The score-evaluation-block 314 can for example apply linear prediction or regression, use a neural network, or perform any other functionality that can map the received SBR-features to a value for the output score 316.

Figure 4:
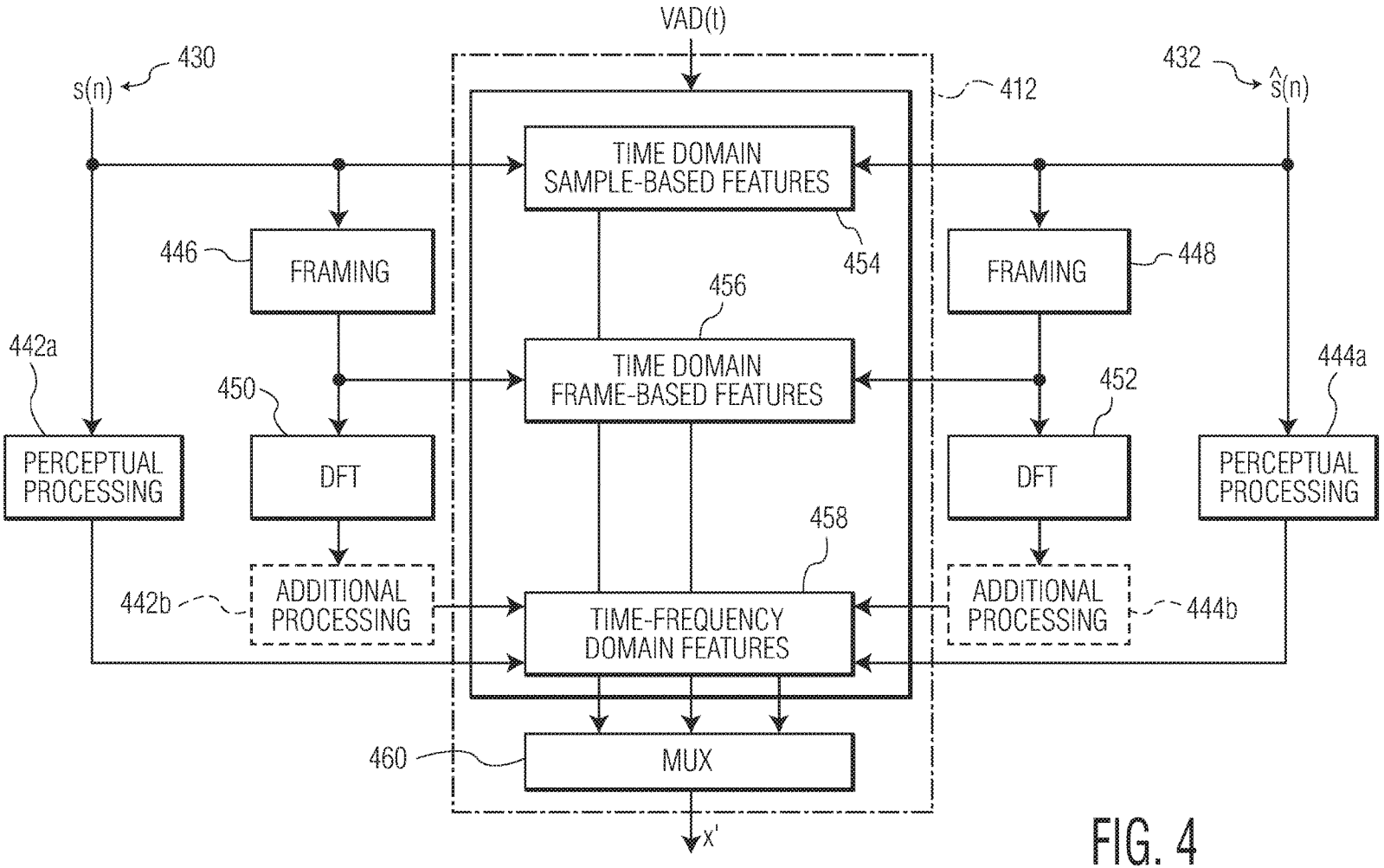
FIG. 4 illustrates a block diagram of a system that can be used to extract features from a degraded signal, including an ABE-processed degraded signal.

FIG. 4 illustrates a block diagram of a system that can be used to extract features from a degraded signal, including an ABE-processed degraded signal.

The system includes a disturbance calculator 412, which has three feature extraction blocks: a time domain sample-based feature extraction block 454, a time domain frame-based feature extraction block 456, and a time-frequency domain feature extraction block 458. The disturbance calculator 412 also includes a multiplexor 460 that can combine individual features generated by the various blocks into a feature vector x'.

Each of the features that is determined by the disturbance calculator 412 can be calculated using complete input signals, only segments/frames of input signals for which voice activity has been detected, or only segments/frames with speech pauses (based on the VAD decision).

The system receives a reference-speech-signal 430 and a degraded-speech-signal 432. These input signals are provided to the time domain sample-based feature extraction block 454. The sample-based feature extraction block 454 can process the received time domain signals and generate one or more sample-based-features for inclusion in the feature vector x'. Examples of features that can be determined by the sample-based feature extraction block 454 will be discussed in more detail with reference to FIG. 5.

The system of FIG. 4 also includes a reference-framing-block 446 and a degraded-framing-block 448. The reference-framing-block 446 processes the reference-speech-signal 430 and generates a framed-reference-signal, which is still in the time domain. The data in the framed-reference-signal is split into a plurality of frames with frame index t. Similarly, the degraded-framing-block 448 processes the degraded-speech-signal 432 and generates a framed-degraded-signal. The time resolution of the framing can be set for a specific application. In one example, the frame length is 16 ms, and no overlapping is used.

The time domain frame-based feature extraction block 456 can process the framed-reference-signal and the framed-degraded-signal and generate one or more frame-based-features for inclusion in the feature vector x'. Examples of features that can be determined by the frame-based feature extraction block 456 will be discussed in more detail with reference to FIG. 5.

The system of FIG. 4 also includes a reference-DFT-block 450 and a degraded-DFT-block 452. The reference-DFT-block 450 performs a digital Fourier transform on the framed-reference-signal in order to provide a time-frequency-domain-reference-speech-signal for the time-frequency domain feature extraction block 458. In some examples, optional additional processing 442*b* may be performed on the output signal of the reference-DFT-block 450 in order to provide a suitable time-frequency domain signal to the time-frequency domain feature extraction block 458. For example, additional processing 442*b* may include weighting of bands to emphasise the importance of some bands, removing components below a hearing threshold, and other perceptual processing (or combinations). Similarly, the degraded-DFT-block 452 performs a digital Fourier transform on the degraded-reference-signal in order to provide a time-frequency-domain-degraded-speech-signal for the time-frequency domain feature extraction block 458. Again, optional additional processing 444*b* may be performed on the output signal of the degraded-DFT-block 452.

The reference-DFT-block 450 and the optional additional processing block 442*b* can be considered as an example of a reference-time-frequency-block because it/they provide a time-frequency-domain-reference-speech-signal for the disturbance calculator 412. Similarly, the degraded-DFT-block 452 and the optional additional processing block 444*b*, can be considered as an example of a degraded-time-frequency-block because it/they provide a time-frequency-domain-degraded-speech-signal for the disturbance calculator 412.

In FIG. 4, the system also includes a reference-perceptual-processing-block 442*a* and a degraded-perceptual-processing-block 444*a*. As discussed above, these blocks can be used to simulate aspects of human hearing and can provide signals in the time-frequency domain. Therefore, these blocks can also be considered as examples of reference-time-frequency-blocks/degraded-time-frequency-blocks.

The time-frequency domain feature extraction block 458 can process the time-frequency-domain-reference-speech-signal and the time-frequency-domain-degraded-speech-signal and generate one or more time-frequency-domain-features for inclusion in the feature vector x'. Examples of time-frequency-domain-features include SBR-features. Other features that can be determined by the time-frequency domain feature extraction block 458 will be discussed in more detail with reference to FIG. 5.

Figure 5:
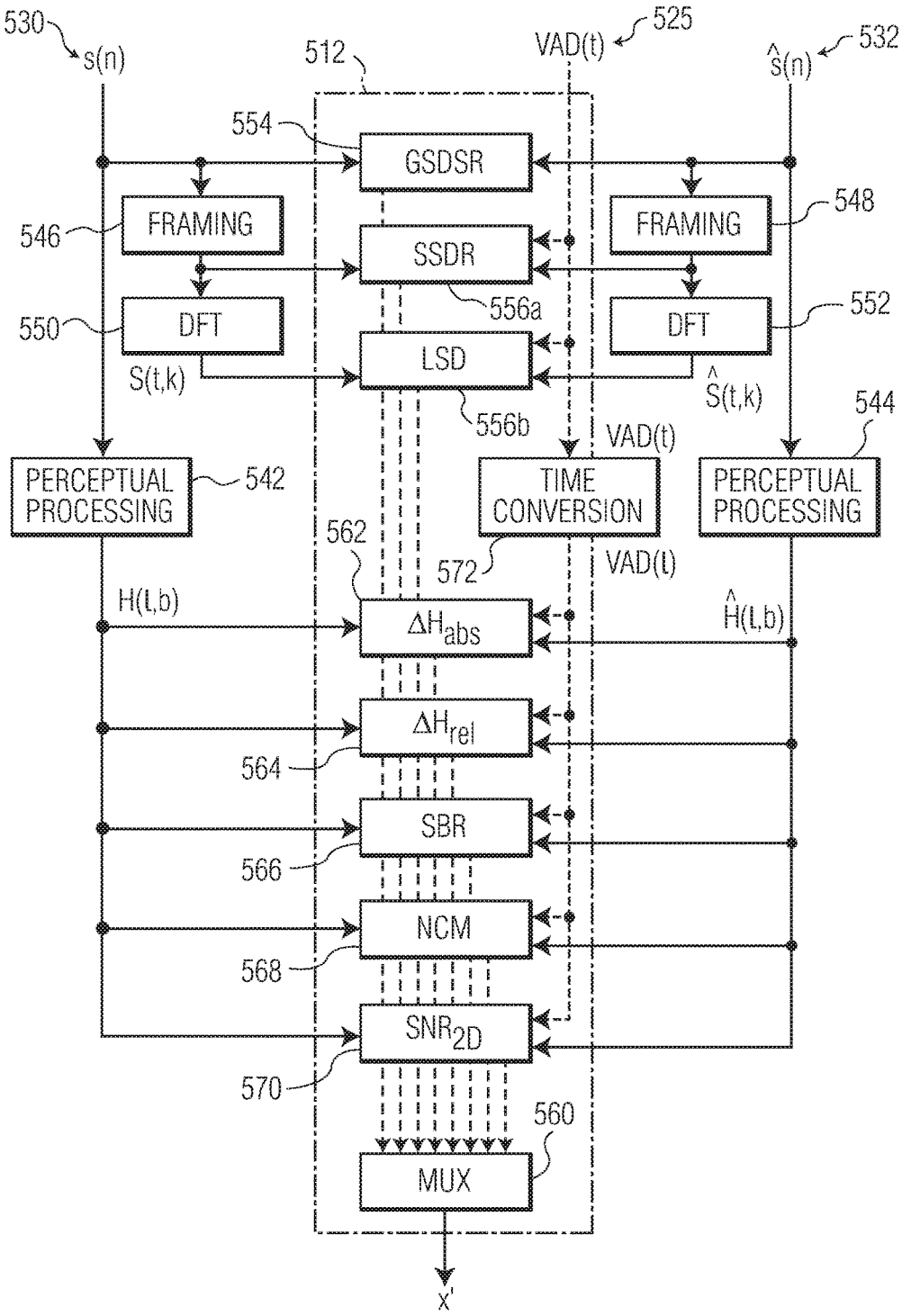
FIG. 5 shows a more detailed illustration of how specific features can be extracted/determined.

FIG. 5 shows a more detailed illustration of how specific features can be extracted/determined by the disturbance calculator. Components of FIG. 5 that are also illustrated in FIG. 4 have been given corresponding reference numbers in the 500 series, and will not necessarily be described again here.

The disturbance calculator 512 in this example also receives a voice-indication-signal VAD(t) 525 from a VAD such as the one illustrated in FIG. 2. One or more of the processing blocks within the disturbance calculator 512 can use the voice-indication-signal VAD(t) 525 to distinguish between frames that include speech (voice active frames) and those that do not.

In the following description, the parameter $\mathcal{T}$ is used to denote a set of frames for which a mean value and a variance value can be calculated, and $\mathcal{T}$ denotes the number of elements contained in the set $\mathcal{T}$.

To express a measured distortion for the entire signal, single features are needed that can be part of the feature vector x'. Hence, for a given frame-wise distortion measure D(t), mean μ and variance $\sigma^2$ can be calculated as follows:

$$\mu(D(t);\mathcal{T}) = \frac{1}{|\mathcal{T}|}\sum_{t\in\mathcal{T}} D(t),$$

$$\sigma^2(D(t);\mathcal{T}) = \frac{1}{|\mathcal{T}|}\sum_{t\in\mathcal{T}} (D(t)-\mu(D(t);\mathcal{T}))^2$$

Typically, however not exclusively, the following sets are used:

$$\mathcal{T}_1=\{t|\mathrm{VAD}(t)=1\}$$

$$\mathcal{T}_0=\{t|\mathrm{VAD}(t)=0\}$$

to define frames with speech present and speech pauses.

In the above equations parameter t is used to denote frame index. However, since different feature extraction blocks can use different framing parameters, l may also be used to denote frame index further in the text. In such case $\mathcal{L}$, $|\mathcal{L}|$μ(D(l); $\mathcal{L}$), $\sigma^2$ (D(l); $\mathcal{L}$), $\mathcal{L}_1$, $\mathcal{L}_0$ are defined analogically.

Various processing blocks of the disturbance calculator 512 process time-frequency domain signals that are output by the perceptual-processing-blocks 542, 544 that can define a hearing model. Several psychoacoustic models are known and used in speech signal processing. In one implementation, the hearing model developed by Roland Sottek ("Modelle zur Signalverarbeitung im menschlichen Gehör," Dissertation, RVVWTH Aachen, Germany, 1993) is applied by the perceptual-processing-blocks 542, 544. Processing the input signals with the hearing model results in H(l,b) and $\hat{H}$(l,b) for the reference and degraded input, respectively, where b is a filter bank band index. $\hat{H}$(l,b) can also be referred to as the time-frequency-domain-degraded-speech-signal. H(l,b) can also be referred to as the time-frequency-domain-reference-speech-signal.

The definition of the filter bank bands (as used in this embodiment) with their respective lower cut-off frequency $f_l$, center frequency $f_c$ and upper cut-off frequency $f_u$, as well as the resulting frequency bandwidth $f_\Delta$ are shown in the below table, which shows a Bark filter bank definition.

| | $\mathcal{B}$ | b | $f_l$(b) [Hz] | $f_c$(b) [Hz] | $f_u$(b) [Hz] | $f_\Delta$(b) [Hz] |
|---|---|---|---|---|---|---|
| $\mathcal{B}$ | — | 1 | 0 | 50 | 100 | 100 |
| | | 2 | 100 | 150 | 200 | 100 |
| | | 3 | 200 | 250 | 300 | 100 |
| | | 4 | 300 | 350 | 400 | 100 |
| | | 5 | 400 | 450 | 510 | 110 |
| | | 6 | 510 | 570 | 630 | 120 |
| | | 7 | 630 | 700 | 770 | 140 |
| | | 8 | 770 | 840 | 920 | 150 |
| | | 9 | 920 | 1000 | 1080 | 160 |
| | $\mathcal{B}_{LB}$ | 10 | 1080 | 1170 | 1270 | 190 |
| | | 11 | 1270 | 1370 | 1480 | 210 |
| | | 12 | 1480 | 1600 | 1720 | 240 |
| | | 13 | 1720 | 1850 | 2000 | 280 |
| | | 14 | 2000 | 2150 | 2320 | 320 |
| | | 15 | 2320 | 2500 | 2700 | 380 |
| | | 16 | 2700 | 2900 | 3150 | 450 |
| | | 17 | 3150 | 3400 | 3700 | 550 |
| | — | 18 | 3700 | 4000 | 4400 | 700 |
| | $\mathcal{B}_{UB}$ | 19 | 4400 | 4800 | 5300 | 900 |
| | | 20 | 5300 | 5800 | 6400 | 1100 |
| | | 21 | 6400 | 7000 | 7700 | 1300 |

Additionally, the bands are split into lower and upper ranges. This division could vary, depending on the applied hearing model. In this embodiment the split is at 4 kHz so the lower band (LB) and upper band (UB) are defined as:

$$\mathcal{B}_{LB}=\{b|1\text{ kHz}\le f_l(b)<f_c(b)<f_u(b)\le 4\text{ kHz}\}$$

$$\mathcal{B}_{B_{UB}}=\{b|4\text{ kHz}\le f_l(b)<f_c<(b)<f_u(b)\le 8\text{ kHz}\}$$

with band numbers being:

$$\mathcal{B}_{LB}=\{10,\ldots,17\}$$

$$\mathcal{B}_{UB}=\{19,\ldots,21\}$$

The framing parameters used in the hearing model might differ from the ones used by the framing blocks 546, 548 (for example when calculating SSDR and LSD, as discussed below), and so for features that are based on perceptually processed signals, the frame index l is used. The voice-indication-signal VAD(t) 525 can therefore be converted via interpolation to VAD(l), for example by the time conversion block 572 shown in FIG. 5. In this embodiment, the frame length for the perceptual processing is set to 3.3 ms.

To obtain single features from a time-frequency representation of a given distortion D(l,b), where l is frame index and b is a frequency band identifier, the mean and variance can be calculated as follows:

$$\mu(D(l,b);\mathcal{L},\mathcal{B}) = \frac{1}{A}\sum_{l\in\mathcal{L}}\sum_{b\in\mathcal{B}} |D(l,b)|\, f_\Delta(b)$$

$$\sigma^2(D(l,b);\mathcal{L},\mathcal{B}) = \left[\frac{1}{A}\sum_{l\in\mathcal{L}}\sum_{b\in\mathcal{B}} |D(l,b)|^2 f_\Delta(b)\right] - \mu(D(l,b);\mathcal{L},\mathcal{B})^2$$

with $A=|\mathcal{L}|\cdot\sum_{b\in\mathcal{B}} f_\Delta(b)$ compensating for signal length $\mathcal{L}$ and a set $\mathcal{B}$ of frequency bands.

In order to perform frequency integration, the time-frequency representation of a given distortion D(l,b) can also be integrated only over a set $\mathcal{B}$ of frequency bands leading to D(l):

$$D(l) = \mu(D(l, b); \mathcal{B})$$

$$= \frac{1}{\Sigma_{b\in\mathcal{B}} f_\Delta(b)} \sum_{b\in\mathcal{B}} |D(l, b)| f_\Delta(b)$$

Again, all above equations could be written analogically using different parameters for frame index (t instead of l and $\mathcal{T}$ instead of $\mathcal{L}$) or frequency bin index (k instead of b and K instead of $\mathcal{E}$).

The disturbance calculator 512 includes eight feature extraction blocks 554, 556*a*, 556*b*, 562, 564, 566, 568, 570, which can each generate a feature, or set of features, for including in a feature vector x'. The processing performed by each of these feature extraction blocks will now be described in turn.

Global Signal-to-Degraded-Speech Ratio (GSDSR)

A GSDSR block 554 can perform sample-based processing on the reference-speech-signal 430 and the degraded-speech-signal 432 in order to determine a Global Signal-to-Degraded-Speech Ratio (GSDSR). The GSDSR is an example of a sample-based-feature, and is indicative of a comparison of energy derived over all samples of the speech signals:

$$GSDSR = 10\log_{10}\left(\frac{\sum_{n\in N} s^2(n)}{\sum_{n\in N} \hat{s}^2(n)}\right)$$

Speech-to-Speech Distortion-Ratio (SSDR)

An SSDR block 556*a* can perform frame-based processing on the framed-reference-speech-signal 430 and the degraded-speech-signal 432 in order to determine a Speech-to-Speech Distortion-Ratio (SSDR). The SSDR can be used to determine frame-based-features.

The SSDR is calculated from the input signals s(n) 430 and ŝ(n) 432 as:

$$SSDR'(t) = 10\log_{10}\left(\frac{\sum_{n\in N} s(n)^2}{\sum_{n\in N_t} (\hat{s}(n) - s(n))^2}\right)$$

with $\mathcal{N}_t$ being the set of samples belonging to frame t. Subsequently, SSDR'(t) is limited to a range of [0 dB; 30 dB] using $$\mathrm{SSDR}(t)=\min\{\mathrm{SSDR}'(t),30\ \mathrm{dB}\}$$

The following SSDR-features, which are examples of frame-based-features, can then extracted as:

a) a mean value of SSDR for frames that include speech (voice active frames), $$\mu(\mathrm{SSDR}(t); \mathcal{T}_1);$$

b) a mean value of SSDR for frames that do not include speech (speech pauses), $$\mu(\mathrm{SSDR}(t); \mathcal{T}_0);$$

c) a variance value of SSDR for frames that include speech, $$\sigma^2(\mathrm{SSDR}(t); \mathcal{T}_1);$$

d) a variance value of SSDR for frames that do not include speech, $$\sigma^2(\mathrm{SSDR}(t); \mathcal{T}_0)$$

In a particularly advantageous embodiment, the calculation is performed over voice active frames to detect a frequency-independent mismatch of the energy and phase between the reference and the degraded speech signal. Furthermore, mean and variance can be calculated over speech pauses, to detect if and to which degree the ABE solution mistakenly added content in the upper band.

Log Spectral Distortion (LSD)

An LSD block 556*b* can perform processing on a time-frequency domain representation of the framed-reference-signal and the framed-degraded-signal in order to determine a Log Spectral Distortion (LSD). These time-frequency domain representations are provided by the reference-DFT-block 550 and the degraded-DFT-block 452. The LSD can be used to determine time-frequency-domain-features.

LSD is a measure of spectral distance between short-term spectra Ŝ(t,k) and S(t,k) for the degraded and reference speech signal, respectively, with k being the frequency bin index. In one implementation, these spectra are calculated by DFT blocks that apply the K=512-point Discrete Fourier Transform (DFT) with a frame length 32 ms and 50% overlap.

$$LSD(t) = \sqrt{\frac{1}{k_a - k_l + 1} \sum_{k=k_l}^{k_u} \left[10\log_{10}\left(\frac{|S(t, k)|^2}{|\hat{S}(t, k)|^2}\right)\right]^2}.$$

Furthermore, the calculation is limited to the frequency range 50 Hz<=f<=7000 Hz, therefore $$k_l = \mathrm{floor}\left(\frac{K}{16000\ \mathrm{Hz}} 50\ \mathrm{Hz}\right) = 3 \text{ and } k_u = \mathrm{floor}\left(\frac{K}{16000\ \mathrm{Hz}} 7000\ \mathrm{Hz}\right) = 448$$

The following LSD-features, which are examples of time-frequency-domain-features, can then be extracted as:

a) a mean value of LSD for frames that include speech (voice active frames), $$\mu(\mathrm{LSD}(t); \mathcal{T}_1);$$

b) a variance value of LSD for frames that include speech, $$\sigma^2(\mathrm{LSD}(t); \mathcal{T}_1).$$

In this example, the mean and variance are calculated only over frames with speech present to measure the accuracy of the estimation of the spectrum in general.

Absolute Distortion ($\Delta H_{abs}$)

An absolute distortion ($\Delta H_{abs}$) block 562 can perform processing on the time-frequency-domain-reference-speech-signal (H(l,b)) and the time-frequency-domain-degraded-speech-signal (Ĥ(l,b)) as provided by the perceptual processing blocks 542, 544, in order to calculate an Absolute Distortion ($\Delta H_{abs}$). The Absolute Distortion ($\Delta H_{abs}$) can be used to determine time-frequency-domain-features.

$\Delta H_{abs}$ is the difference between the representations of the reference and degraded signals after applying the hearing model:

$$\Delta H_{abs}(l, b) = 10\log_{10}\left(\frac{|H(l, b)|^2}{|\hat{H}(l, b)|^2}\right)$$

$\Delta H_{abs}$ represents the absolute difference between the reference and the degraded signal, based on the time-frequency- (here: hearing model-) processed representations H and $\hat{H}$.

For the calculation of individual time-frequency-domain-features, we define:

$$\mathcal{L}_{+}=\{l|\mu(\Delta H_{abs}(l,b);\mathcal{B})>0\}$$

$$\mathcal{L}_{-}=\{l|\mu(\Delta H_{abs}(l,b);\mathcal{B})\leq 0\}$$

If the mean of $\Delta H_{abs}$ over all frequencies (here Bark bands) is greater than 0 then the energy of the frequency components in the degraded speech signal is higher than the energy of the frequency components in the reference speech signal. In other words: the ABE processing (wrongly) added (+) parts to the signal that should not be there. All frames for which this is the case are denoted as L+. The frame set L− denotes the opposite: the ABE-processed speech signal is lacking (−) frequency components where they should have been.

Also, similar processing can be performed for the upper bands of the signals. In this example the boundary between the upper and lower bands is 4 kHz. In this way, the feature can focus on ABE synthesized components in the upper band.

$$\mathcal{L}_{UB+}=\{l|\mu(\Delta H_{abs}(l,b);\mathcal{B}_{UB})>0\}$$

$$\mathcal{L}_{UB-}=\{l|\mu(\Delta H_{abs}(l,b);\mathcal{B}_{UB})\leq 0\}$$

ABE solutions can aim to restore missing frequency components as accurately as possible. Therefore, the features calculated from the $\Delta H_{abs}$ can especially focus on added and omitted components, as a more precise measure for ABE errors than just the overall distortion.

The following absolute-distortion-features, which are examples of time-frequency-domain-features, can then be extracted as:

a) a mean value of $\Delta H_{abs}$ for frames that include speech (voice active frames), $$\mu(|\Delta H_{abs}(l,b)|;\mathcal{L}_{1},\mathcal{B});$$

b) a variance value of $\Delta H_{abs}$ for frames that include speech (voice active frames), $$\sigma^2|H_{abs}(l,b)|;\mathcal{L}_{1},\mathcal{B});$$

c) a mean value of $\Delta H_{abs}$ for frames that include speech (voice active frames) and for which $\Delta H_{abs}$ is positive (added components), $$\mu(|\Delta H_{abs}(l,b)|;\mathcal{L}_{+}\cap\mathcal{L}_{1},\mathcal{B});$$

d) a variance value of $\Delta H_{abs}$ for frames that include speech (voice active frames) and for which $\Delta H_{abs}$ is positive (added components)

$$\sigma^2(|\Delta H_{abs}(l,b)|;\mathcal{L}_{+}\cap\mathcal{L}_{1},\mathcal{B});$$

e) a mean value of $\Delta H_{abs}$ for frames that include speech (voice active frames) and for which $\Delta H_{abs}$ is negative (omitted components), $$\mu(|\Delta H_{abs}(l,b)|;\mathcal{L}_{-}\cap\mathcal{L}_{1},\mathcal{B});$$

f) a variance value of $\Delta H_{abs}$ for frames that include speech (voice active frames) and for which $\Delta H_{abs}$ is negative (omitted components), $$\sigma^2(|\Delta H_{abs}(l,b)|;\mathcal{L}_{-}\cap\mathcal{L}_{1},\mathcal{B});$$

g) a mean value of $\Delta H_{abs}$ for frames that include speech (voice active frames), and for which $\Delta H_{abs}$ is positive (added components), and for high-band frequency components (by considering only b which represent frequency components higher than frequency-threshold (4 kHz)), $$\mu(|\Delta H_{abs}(l,b)|;\mathcal{L}_{UB+}\cap\mathcal{L}_{1},\mathcal{B});$$

h) a variance value of $\Delta H_{abs}$ for frames that include speech (voice active frames), and for which $\Delta H_{abs}$ is positive (added components), and for high-band frequency components (by considering only b which represent frequency components higher than frequency-threshold (4 kHz)), $$\sigma^2(|\Delta H_{abs}(l,b)|;\mathcal{L}_{UB+}\cap\mathcal{L}_{1},\mathcal{B});$$

i) a mean value of $\Delta H_{abs}$ for frames that include speech (voice active frames) and for which $\Delta H_{abs}$ is negative (omitted components), and for high-band frequency components (by considering only b which represent frequency components higher than frequency-threshold (4 kHz)), $$\mu(|\Delta H_{abs}(l,b)|;\mathcal{L}_{UB-}\cap\mathcal{L}_{1},\mathcal{B});$$

j) a variance value of $\Delta H_{abs}$ for frames that include speech (voice active frames) and for which $\Delta H_{abs}$ is negative (omitted components), and for high-band frequency components (by considering only b which represent frequency components higher than frequency-threshold (4 kHz)), $$\sigma^2(|\Delta H_{abs}(l,b)|;\mathcal{L}_{UB-}\cap\mathcal{L}_{1},\mathcal{B}).$$

Relative Distortion ($\Delta H_{rel}$)

A relative distortion ($\Delta H_{rel}$) block 564 can perform processing on the time-frequency-domain-reference-speech-signal (H(l,b)) and the time-frequency-domain-degraded-speech-signal ($\hat{H}$(l,b)) as provided by the perceptual processing blocks 542, 544, in order to calculate a Relative Distortion ($\Delta H_{rel}$). The Relative Distortion ($\Delta H_{rel}$) can be used to determine time-frequency-domain-features.

$\Delta H_{rel}$ is a spectral domain SNR calculated after applying the hearing model $$\Delta H_{rel}(l,b)=10\log_{10}\left(\frac{|H(l,b)|^2}{(|H(l,b)|-|\hat{H}(l,b)|)^2}\right)$$

Calculated in the time-frequency domain (here: after applying a hearing model), the relative distortion can be interpreted as signal-to-distortion ratio (in analogy to the well-known signal-to-noise ratio). The denominator represents the distortion: a small distortion results in a high $\Delta H_{rel}$ and vice versa. The disturbance is calculated relatively to H: The higher H, the more distortion is tolerated by this measure.

The following $\Delta H_{rel}$-features, which are examples of time-frequency-domain-features, can then be extracted as:

a) a mean value of $\Delta H_{rel}$ for frames that include speech, $$\mu(\Delta H_{rel}(l,b);\mathcal{L}_{1},\mathcal{N});$$

b) a variance value of $\Delta H_{rel}$ for frames that include speech, $$\sigma^2(\Delta H_{rel}(l,b);\mathcal{L}_{1},\mathcal{N});$$

In some examples, before calculation of mean and variance, $\Delta H_{rel}$ can be limited to a maximum value such as 45 dB.

Two-Dimensional Correlation ($SNR_{2D}$)

A Two-dimensional correlation block 570 can perform processing on the time-frequency-domain-reference-speech-signal (H(l,b)) and the time-frequency-domain-degraded-speech-signal ($\hat{H}$(l,b)), in order to calculate a Two-dimensional correlation value. The Two-dimensional correlation is an example of a time-frequency-domain-feature.

The two-dimensional Pearson's correlation is calculated using H(l,b) and $\hat{H}$(l,b), leading to a single correlation value:

$$\rho_{2D} = \frac{\sum_{l\in\mathcal{L}}\sum_{b\in\mathcal{B}}(|H(l,b)|-\overline{H})\left(\left|\hat{H}(l,b)\right|-\overline{\hat{H}}\right)}{\sqrt{\sum_{l\in\mathcal{L}}\sum_{b\in\mathcal{B}}(|H(l,b)|-\overline{H})^2}\sqrt{\sum_{l\in\mathcal{L}}\sum_{b\in\mathcal{B}}\left(\left|\hat{H}(l,b)\right|-\overline{\hat{H}}\right)^2}},$$

with $$\overline{H} = \frac{1}{|\mathcal{L}|}\frac{1}{|\mathcal{B}|}\sum_{l\in\mathcal{L}}\sum_{b\in\mathcal{B}}|H(l,b)|$$

$$\overline{\hat{H}} = \frac{1}{|\mathcal{L}|}\frac{1}{|\mathcal{B}|}\sum_{l\in\mathcal{L}}\sum_{b\in\mathcal{B}}|\hat{H}(l,b)|$$

The two-dimensional correlation can set the focus on the temporal and spectral progress, while precise equality of frequency components over time is less important.

An SNR-based two-dimensional-correlation-feature can also be calculated according to:

$$SNR_{2D} = 10\log_{10}\left(\frac{(\rho_{2D})^2}{(1-\rho_{2D})^2}\right)$$

Normalized Covariance Metric (NCM)

A Normalized Covariance Metric (NCM) block 568 can perform processing on the time-frequency-domain-reference-speech-signal (H(l,b)) and the time-frequency-domain-degraded-speech-signal ($\hat{H}$(l,b)), in order to calculate a Normalized Covariance Metric (NCM). The Normalized Covariance Metric (NCM) is an example of a time-frequency-domain-feature.

The Normalized Covariance Metric (NCM) is based on the covariance between the time-frequency domain representations of the reference and the degraded signals. In this case the time-frequency representation is obtained by applying the hearing model to both input signals. However, we could also use an STFT representation (or any other time-frequency domain representation) with a proper filter bank (for example, based on the Bark scale) and apply an appropriate weighting. The NCM measure is calculated on temporal envelopes. These might be calculated from filter bank outputs, either in time-frequency domain or time domain. In this implementation, the time-frequency-domain-reference-speech-signal (H(l,b)) and the time-frequency-domain-degraded-speech-signal ($\hat{H}$(l,b)) were already subject to temporal envelope calculation during hearing model processing. In case a different hearing model which does not include temporal envelope calculation or a simple time to time-frequency domain transform is used to obtain the time-frequency-domain-reference-speech-signal (H(l,b)) and the time-frequency-domain-degraded-speech-signal ($\hat{H}$(l,b)) the temporal envelope may be calculated using the Hilbert transform $\mathcal{H}$:

$$u(l,b)=|\mathcal{H}(|H(l,b)|)|$$

$$\hat{u}(l,b)=|\mathcal{H}(|\hat{H}(l,b)|)|$$

In this implementation, however, $$u(l,b)=|H(l,b)|$$

$$\hat{u}(l,b)=|\hat{H}(l,b)|$$

holds. Afterwards, a correlation between the transforms obtained for degraded and reference signal is calculated for each band b:

$$\rho_{NCM}(b) = \frac{\sum_{l\in\mathcal{L}}(u(l,b)-\overline{u}(b))\cdot\left(\hat{u}(l,b)-\overline{\hat{u}}(b)\right)}{\sqrt{\sum_{l\in\mathcal{L}}(u(l,b)-\overline{u}(b))^2}\cdot\sqrt{\sum_{l\in\mathcal{L}}\left(\hat{u}(l,b)-\overline{\hat{u}}(b)\right)^2}}$$

with $$\overline{u}(b) = \mu(u(l,b);\mathcal{L}) \text{ and } \overline{\hat{u}}(b) = \mu(\hat{u}(l,b);\mathcal{L}).$$

These correlation values can then be converted to SNR-like NCM-features and thresholded to a value range of [−15 dB; 15 dB] using:

$$SNR'_p(b) = 10\log_{10}\left(\frac{\rho_{NCM}(b)^2}{(1-\rho_{NCM}(b))^2}\right)$$

$$SNR_p(b) = \min(\max(SNR'_p(b), -15\text{ dB}), 15\text{ dB})$$

The resulting $SNR_\rho(b)$ is then shifted by 15 dB, so that it is always non-negative, and scaled by 30 dB. A weighted sum leads to the final NCM following:

$$SNR_{NCM}(b) = \frac{SNR_\rho(b) + 15\text{ dB}}{30\text{ dB}}$$

$$NCM = \frac{\sum_{b\in\mathcal{B}} w(b)\cdot SNR_{NCM}(b)}{\sum_{b\in\mathcal{B}} w(b)}$$

In this embodiment, the weights w(b) are set to 1 for all b. However, they can, for example, be correlated with the frequency bandwidth $f_\Delta(b)$.

In general the band-limited speech signal (which is the input to ABE solutions) does not contain enough mutual information with the missing upper band, for example 4 kHz<f<8 kHz, for the ABE algorithm to be capable of restoring it perfectly. In other words, there is no one-to-one correspondence between the lower band (LB) (0 kHz<f<4 kHz), and the upper band of a wideband speech signal. Thus, ABE solutions can only deliver an approximation of upper band frequency components. The instrumental measure suited to evaluate the quality of ABE processed signals should asses how good that approximation is. Therefore, apart from features that correspond to the overall quality of the degraded signal (mean/variance of $\Delta H_{abs}$, mean/variance $\Delta H_{rel}$, $\rho_{2D}$, $SNR_{2D}$), the employed feature set contains features that try to detect typical errors introduced by ABE solutions. An overview of these errors and suitable features used in this invention is given in the below table.

| Errors of ABE solutions | Feature(s) explicitly detecting the error |
|---|---|
| Overestimation of UB's energy (hissing artifacts) | SBR-features<br>Mean/Variance of $\Delta H_{abs}$ for added components |
| Underestimation of UB's energy (lisping artifacts) | SBR-features<br>Mean/Variance of $\Delta H_{abs}$ for omitted components |
| Spectral imbalance between UB and LB | SBR-features |
| WB reconstruction artifacts for background noise (VAD(t) = 0) | Mean/Variance of SSDR (during absence of speech) |
| High energy short-term disturbances | GSDSR<br>Mean/Variance of SSDR |

-continued

| Errors of ABE solutions | Feature(s) explicitly detecting the error |
|---|---|
| Errors in spectral envelope estimation | Mean/variance of $\Delta H_{abs}$ for upper-band frequencies |
| Energy and phase errors over all frequencies | Mean/Variance of SSDR (during presence of speech) Mean/Variance of LSD |

It will be appreciated that the instrumentally measurable disturbance between the two input signals can be reflected in several features, focusing on different kinds of distortions. These features can be derived from the time representation of the signal (based on sample-wise or frame-wise calculation), and different time-frequency representations, one of which being the output of the perceptual model that simulates human hearing.

The system of FIG. 5 also includes a multiplexor 560 that can combine one or more of the features that are calculated by the disturbance calculator 512 into a feature vector x'. It will be appreciated that in some examples, the disturbance calculator 512 may calculate and output only a subset of the various features that are described above. In this way, the feature vector x' can be any subset of the features presented above in this document, and not all features have to be used. Furthermore, some features can be calculated with individual framing structure or frequency resolution, and using different time-frequency transformations.

Returning to FIG. 2, the feature normalization block 234 in the cognitive model 214 can normalize the feature vector x' that is provided by the disturbance calculator of FIG. 5. In this implementation, the feature vector x' calculated for a given signal under test is normalized using the mean and standard deviation obtained during a training stage of the statistical model that is applied by the cognitive model 214. Before the statistical model was trained, features were calculated for a set of training files, leading to a matrix $X'_T$ with $$\text{dimension}(X'_T)=(\text{no. of files in training})\times(\text{features per file}).$$

The calculated features were then normalized ("zero mean" and "unit variance"), leading to the normalized feature matrix $$X_T = \frac{X'_t - \mu(X'_T)}{\sigma(X'_T)},$$

with the mean $\mu(X'_T)$ and the standard deviation $\sigma(X'_T)$ of each feature calculated over all files in training. Subsequently, the statistical model was trained on $X_T$.

In order to adapt feature vector x' to the value range the statistical model was trained on, the obtained features are normalized as follows:

$$x = \frac{x - \mu(X'_T)}{\sigma(X'_T)}$$

The cognitive model 214 uses a statistical model to link the observed distortion, that is the feature vector x', to the predicted MOS-LQO score 216. Possible statistical models are for example linear regression, multivariate linear regression, artificial neural networks, support vector machines and others. The statistical model can only be used if the respective parameters were found during the training phase. Therefore, the model's input is not only the normalized feature vector x, but also a stored parameter set obtained in preceding training stage. This stored parameter set can be accessible from memory 240.

Most of the statistical models work best if they are trained on normalized input and output data. Therefore, in this implementation, not only the feature dimensions (as described above) were normalized during training, but also the desired target values MOS-LQS 216. As a consequence, the statistical model (MOS predictor 236) outputs "normalized" predicted MOS-LQO' scores that should be denormalized by the score denormalization block 238 using:

$$\text{MOS-LQO}=\text{MOS-LQS}'\cdot\sigma(\text{MOS-LQS}'_T)+\mu(\text{MOS-LQS}'_T)$$

with $\mu(\text{MOS-LQS}'_T)$ and $\sigma(\text{MOS-LQS}'_T)$ being the mean and standard deviation of the MOS-LQS values used in the training process.

The resulting MOS-LQO 216 value is the output of the instrumental measure of the system of FIG. 2.

In this embodiment, support vector machines (SVM) serve as the cognitive model 214, operating in a normalized feature and score space. SVM can be a particularly reliable and robust statistical model, considering a rather small amount of training data available during development.

Applications of Speech-Signal-Processing-Circuits Disclosed Herein

High definition (HD) Voice (wideband voice) enables operators to differentiate their service offering high quality voice calls on mobile networks. This higher quality (more clarity, higher intelligibility) of voice calls is achieved by transmitting the [4-7 kHz] speech band, which is usually dropped in traditional narrowband telephony. However, for every end-user to benefit from HD Voice for every call, every device and network have to support HD Voice. If one element in the chain does not support it, then the call turns to narrowband.

Bandwidth extension algorithms attempt to generate wideband content from a narrowband audio source, to improve voice quality during narrowband calls. Currently, to measure the degree of this improvement for different ABE systems, one has to perform extensive, time-consuming subjective listening tests. The examples of functionality provided by a speech-signal-processing-circuit that are described herein provide an alternative to the listening tests that will advantageously allow:

- Developers to speed-up development and parameterization for further improvement.
- Network operators to specify quality requirements, which are easy to test with an instrumental measure.
- Mobile device manufacturers to compare, test and tune different solutions objectively towards the operator's specifications.

One or more of the implementations described above relate to estimating the quality of WB ABE solutions, however, it is possible to expand the applications to other types of signals and other ABE algorithms. For example, with some modifications in features (such as the definitions of the lower and upper bands) and retraining of the statistical model, the examples disclosed herein could be used to estimate the quality of super wideband ABE algorithms.

One or more of the examples disclosed herein provide an objective method for predicting the overall quality of speech as perceived by listeners in Absolute Category Rating (ACR) listening tests. The proposed objective (i.e., instrumental) measure can be designed especially for speech signals processed with artificial bandwidth extension (ABE) algorithms that extend the frequency band of narrowband (NB) signals above 4 kHz (not higher than 8 kHz). However, it is also capable of predicting the perceived quality of signals coded with narrowband and wideband (WB) speech codecs. The measure is an intrusive method, based on a comparison of the speech sample under test with a reference one. A set of features derived from that comparison can be fed into a cognitive model, which can provide a quality score called "Mean Opinion Score-Listening Quality Objective" (MOS-LQO).

The proposed measure advantageously does not need a phonetic transcription. Furthermore, the underlying statistical model can be trained on several languages to minimize language-dependency. The proposed measure can exhibit high linear correlation and rank correlation, as well as low Root Mean Square Error (RMSE) between MOS-LQO and MOS-LQS. Therefore, it can be used for reliable quality prediction in evaluation and comparison of ABE solutions. As tests showed, it can also predict with high accuracy the MOS-LQS of speech signals coded with either the Adaptive Multi-Rate NB (AMR-NB) codec or AMR-WB codec.

The instructions and/or flowchart steps in the above figures can be executed in any order, unless a specific order is explicitly stated. Also, those skilled in the art will recognize that while one example set of instructions/method has been discussed, the material in this specification can be combined in a variety of ways to yield other examples as well, and are to be understood within a context provided by this detailed description.

In some example embodiments the set of instructions/method steps described above are implemented as functional and software instructions embodied as a set of executable instructions which are effected on a computer or machine which is programmed with and controlled by said executable instructions. Such instructions are loaded for execution on a processor (such as one or more CPUs). The term processor includes microprocessors, microcontrollers, processor modules or subsystems (including one or more microprocessors or microcontrollers), or other control or computing devices. A processor can refer to a single component or to plural components.

In other examples, the set of instructions/methods illustrated herein and data and instructions associated therewith are stored in respective storage devices, which are implemented as one or more non-transient machine or computer-readable or computer-usable storage media or mediums. Such computer-readable or computer usable storage medium or media is (are) considered to be part of an article (or article of manufacture). An article or article of manufacture can refer to any manufactured single component or multiple components. The non-transient machine or computer usable media or mediums as defined herein excludes signals, but such media or mediums may be capable of receiving and processing information from signals and/or other transient mediums.

Example embodiments of the material discussed in this specification can be implemented in whole or in part through network, computer, or data based devices and/or services. These may include cloud, internet, intranet, mobile, desktop, processor, look-up table, microcontroller, consumer equipment, infrastructure, or other enabling devices and services. As may be used herein and in the claims, the following non-exclusive definitions are provided.

In one example, one or more instructions or steps discussed herein are automated. The terms automated or automatically (and like variations thereof) mean controlled operation of an apparatus, system, and/or process using computers and/or mechanical/electrical devices without the necessity of human intervention, observation, effort and/or decision.

It will be appreciated that any components said to be coupled may be coupled or connected either directly or indirectly. In the case of indirect coupling, additional components may be located between the two components that are said to be coupled.

In this specification, example embodiments have been presented in terms of a selected set of details. However, a person of ordinary skill in the art would understand that many other example embodiments may be practiced which include a different selected set of these details. It is intended that the following claims cover all possible example embodiments.

The invention claimed is:

1. A speech-signal-processing-circuit configured to receive a time-frequency-domain-reference-speech-signal and a time-frequency-domain-degraded-speech-signal, wherein each of the time-frequency-domain-reference-speech-signal and the time-frequency-domain-degraded-speech-signal comprises a plurality of frames of data, wherein:

the time-frequency-domain-reference-speech-signal is in the time-frequency domain and comprises:

an upper-band-reference-component with frequencies that are greater than a frequency-threshold-value; and a lower-band-reference-component with frequencies that are less than the frequency-threshold-value;

the time-frequency-domain-degraded-speech-signal is in the time-frequency domain and comprises:

an upper-band-degraded-component with frequencies that are greater than the frequency-threshold-value; and a lower-band-degraded-component with frequencies that are less than the frequency-threshold-value;

the speech-signal-processing-circuit comprises:

a disturbance calculator configured to determine one or more spectral balance ratio (SBR) features based on the time-frequency-domain-reference-speech-signal and the time-frequency-domain-degraded-speech-signal by:

for each of a plurality of frames:

determining a reference-ratio based on the ratio of the upper-band-reference-component to the lower-band-reference-component;

determining a degraded-ratio based on the ratio of the upper-band-degraded-component to the lower-band-degraded-component; and determining a spectral-balance-ratio based on the ratio of the reference-ratio to the degraded-ratio; and determining the one or more SBR-features based on the spectral-balance-ratio for the plurality of frames; and a score-evaluation-block configured to determine an output-score for the degraded-speech-signal based on the SBR-features;

wherein the signal-processing-circuit includes an output configured to pass the output-score for the degraded-speech-signal to a set of quality control and/or monitoring circuitry.

2. The speech-signal-processing-circuit of claim 1, wherein the time-frequency-domain-degraded-speech-signal is representative of an extended bandwidth signal, the frequency-threshold-value corresponds to a boundary between a lower band of the extended bandwidth signal, and an upper band of the extended bandwidth signal.

3. The speech-signal-processing-circuit of claim 1, wherein the disturbance calculator is configured to determine one or more of the following SBR-features:

a mean value of the spectral-balance-ratio for frames that have a positive value of spectral-balance-ratio;

a mean value of spectral-balance-ratio for frames that have a negative value of spectral-balance-ratio;

a variance value of spectral-balance-ratio for frames that have a positive value of spectral-balance-ratio;

a variance value of spectral-balance-ratio for frames that have a negative value of spectral-balance-ratio; and a ratio of the number of frames that have a positive value of spectral-balance-ratio, to the number of frames that have a negative value of spectral-balance-ratio.

4. The speech-signal-processing-circuit of claim 1, wherein the speech-signal-processing-circuit is configured to receive a reference-speech-signal and a degraded-speech-signal, wherein each of the reference-speech-signal and the degraded-speech-signal comprises a plurality of frames of data, wherein the speech-signal-processing-circuit comprises:

a reference-time-frequency-block configured to determine the time-frequency-domain-reference-speech-signal based on the reference-speech-signal; and a degraded-time-frequency-block configured to determine the time-frequency-domain-degraded-speech-signal based on the degraded-speech-signal.

5. The speech-signal-processing-circuit of claim 4, wherein the reference-time-frequency-block comprises a reference-perceptual-processing-block and the degraded-time-frequency-block comprises a degraded-perceptual-processing-block, wherein the reference-perceptual-processing-block and the degraded-perceptual-processing-block are configured to simulate one or more aspects of human hearing.

6. The speech-signal-processing-circuit of claim 1, wherein the disturbance calculator comprises a time-frequency domain feature extraction block configured to:

process the time-frequency-domain-reference-speech-signal and the time-frequency-domain-degraded-speech-signal; and determine one or more additional time-frequency-domain-features; and wherein the score-evaluation-block is configured to determine the output-score based on the time-frequency-domain-features.

7. The speech-signal-processing-circuit of claim 6, wherein the time-frequency domain feature extraction block comprises a Normalized Covariance Metric block configured to:

process the time-frequency-domain-reference-speech-signal and the time-frequency-domain-degraded-speech-signal in order to calculate a Normalized Covariance Metric feature, wherein the Normalized Covariance Metric is based on the covariance between the time-frequency-domain-reference-speech-signal and the time-frequency-domain-degraded-speech-signal; and wherein the score-evaluation-block is configured to determine the output-score based on the Normalized Covariance Metric.

8. The speech-signal-processing-circuit of claim 6, wherein the time-frequency domain feature extraction block comprises an absolute distortion block configured to:

process the time-frequency-domain-reference-speech-signal and the time-frequency-domain-degraded-speech-signal in order to calculate an Absolute Distortion, wherein the Absolute Distortion represents the absolute difference between the time-frequency-domain-reference-speech-signal and the time-frequency-domain-degraded-speech-signal; and determine one or more of the following absolute-distortion-features based on the Absolute Distortion:

a mean value of Absolute Distortion for frames that include speech;

a variance value of Absolute Distortion for frames that include speech;

a mean value of Absolute Distortion for frames that include speech and for which Absolute Distortion is positive;

a variance value of Absolute Distortion for frames that include speech and for which Absolute Distortion is positive;

a mean value of Absolute Distortion for frames that include speech and for which Absolute Distortion is negative;

a variance value of Absolute Distortion for frames that include speech and for which Absolute Distortion is negative;

a mean value of Absolute Distortion for frames that include speech, and for which Absolute Distortion is positive, and for upper-band frequency components;

a variance value of Absolute Distortion for frames that include speech, and for which Absolute Distortion is positive, and for upper-band frequency components;

a mean value of Absolute Distortion for frames that include speech and for which Absolute Distortion is negative, and for upper-band frequency components;

a variance value of Absolute Distortion for frames that include speech and for which Absolute Distortion is negative, and for upper-band frequency components; and wherein the score-evaluation-block is configured to determine the output-score based on the absolute-distortion-features.

9. The speech-signal-processing-circuit of claim 6, wherein the time-frequency domain feature extraction block comprises a relative distortion block configured to:

process the time-frequency-domain-reference-speech-signal and the time-frequency-domain-degraded-speech-signal in order to calculate a Relative Distortion as a signal-to-distortion ratio; and determine one or more of the following relative-distortion-features based on the Relative Distortion:

a mean value of Relative Distortion for frames that include speech;

a variance value of Relative Distortion for frames that include speech;

wherein the score-evaluation-block is configured to determine the output-score based on one or more of the relative-distortion-features.

10. The speech-signal-processing-circuit of claim 6, wherein the time-frequency domain feature extraction block comprises a two-dimensional correlation block configured to process the time-frequency-domain-reference-speech-signal and the time-frequency-domain-degraded-speech-signal in order to calculate a two-dimensional correlation value; and wherein the score-evaluation-block is configured to determine the output-score based on the two-dimensional correlation value.

11. The speech-signal-processing-circuit of claim 1, configured to receive a reference-speech-signal and a degraded-speech-signal, wherein the time-frequency-domain-reference-speech-signal is a time-frequency domain representation of the reference-speech-signal, and the time-frequency-domain-degraded-speech-signal is a time-frequency domain representation of the degraded-speech-signal, wherein the disturbance calculator comprises a time domain sample-based feature extraction block configured to:

receive time domain representations of the reference-speech-signal and the degraded-speech-signal; and determine one or more sample-based-features based on the time domain representations of the reference-speech-signal and the degraded-speech-signal; and wherein the score-evaluation-block is configured to determine the output-score based on the sample-based-features.

12. The speech-signal-processing-circuit of claim 11, wherein the time domain sample-based feature extraction block comprises a GSDSR block configured to perform sample-based processing on the time domain representations of the reference-speech-signal and the degraded-speech-signal signals in order to determine a Global Signal-to-Degraded-Speech Ratio, wherein the Global Signal-to-Degraded-Speech Ratio is indicative of a comparison of energy derived over all samples of the reference-speech-signal and the degraded-speech-signal; and wherein the score-evaluation-block is configured to determine the output-score based on the Global Signal-to-Degraded-Speech Ratio.

13. The speech-signal-processing-circuit of claim 1, configured to receive a reference-speech-signal and a degraded-speech-signal, wherein the time-frequency-domain-reference-speech-signal is a time-frequency domain representation of the reference-speech-signal, and the time-frequency-domain-degraded-speech-signal is a time-frequency domain representation of the degraded-speech-signal, wherein the disturbance calculator comprises a time domain frame-based feature extraction block configured to:

receive framed, time domain, representations of the reference-speech-signal and the degraded-speech-signal; and determine one or more frame-based-features based on the framed, time domain, representations of the reference-speech-signal and the degraded-speech-signal; and wherein the score-evaluation-block is configured to determine the output-score based on the frame-based-features.

14. The speech-signal-processing-circuit of claim 13, wherein the disturbance calculator comprises a SSDR block configured to:

process the framed, time domain, representations of the reference-speech-signal and the degraded-speech-signal in order to determine a Speech-to-Speech Distortion-Ratio; and determine one or more of the following SSDR-features based on the Speech-to-Speech Distortion-Ratio:

a mean value of Speech-to-Speech Distortion-Ratio for frames that include speech, a mean value of Speech-to-Speech Distortion-Ratio for frames that do not include speech, a variance value of Speech-to-Speech Distortion-Ratio for frames that include speech, a variance value of Speech-to-Speech Distortion-Ratio for frames that do not include speech; and wherein the score-evaluation-block is configured to determine the output-score based on one or more of the SSDR-features.

15. The speech-signal-processing-circuit of claim 1, further configured to receive a voice-indication-signal, wherein the voice-indication-signal is indicative of whether or not frames of the reference-speech-signal and the degraded-speech-signal contain speech, and wherein the disturbance calculator is configured to determine one or more of the following features based on the voice-indication-signal:

only frames of the reference-speech-signal and the degraded-speech-signal for which the voice-indication-signal is indicative of speech being present, or only frames of the reference-speech-signal and the degraded-speech-signal for which the voice-indication-signal is indicative of speech not being present.

* * * * *